US011660772B2

(12) United States Patent
Mousson

(10) Patent No.: US 11,660,772 B2
(45) Date of Patent: May 30, 2023

(54) SYSTEM FOR PRODUCING LENGTHS OF TUBE COMPRISING HELICALLY WOUND STRIPS

(71) Applicant: IMATEC—INNOVATIVE MACHINE TECHNOLOGY S.A R.L, Ettelbruck (LU)

(72) Inventor: Pierre Jacques Mousson, Spa (BE)

(73) Assignee: IMATEC—INNOVATIVE MACHINE TECHNOLOGY S.A R.L, Ettelbruck (LU)

( * ) Notice: Subject to any disclaimer, the term of this patent is extended or adjusted under 35 U.S.C. 154(b) by 0 days.

(21) Appl. No.: 17/292,942

(22) PCT Filed: Nov. 12, 2019

(86) PCT No.: PCT/EP2019/080939
§ 371 (c)(1),
(2) Date: May 11, 2021

(87) PCT Pub. No.: WO2020/099361
PCT Pub. Date: May 22, 2020

(65) Prior Publication Data

US 2022/0001564 A1 Jan. 6, 2022

(30) Foreign Application Priority Data

Nov. 12, 2018 (NL) ..... 2021979

(51) Int. Cl.

| | |
|---|---|
| ***B26D 3/16*** | (2006.01) |
| ***B26D 1/62*** | (2006.01) |
| ***B31C 3/00*** | (2006.01) |
| ***B31C 11/00*** | (2006.01) |

(52) U.S. Cl.
CPC ..... *B26D 3/16* (2013.01); *B26D 1/62* (2013.01); *B31C 3/00* (2013.01); *B31C 11/00* (2013.01)

(58) Field of Classification Search
CPC ..... B31C 11/04; B31C 3/00; B31D 5/0091; B31D 5/0095; A47G 21/18
See application file for complete search history.

(56) References Cited

U.S. PATENT DOCUMENTS

| | | | | |
|---|---|---|---|---|
| 1,242,478 A * | 10/1917 | Rosewarne | A24C 5/28 | 83/318 |
| 3,942,418 A | 3/1976 | Smith | | |
| 4,370,140 A * | 1/1983 | Fegley | B26D 1/60 | 83/318 |
| 4,914,997 A * | 4/1990 | Belvederi | B26D 1/285 | 83/345 |
| 2017/0305096 A1* | 10/2017 | Dettori | B26D 3/16 | |
| 2021/0046724 A1* | 2/2021 | Schultz | B26D 1/36 | |

OTHER PUBLICATIONS

Netherlands Search Report and Written Opinion dated Apr. 2, 2019, corresponding to Application No. 2021775.
International Search Report and Written Opinion dated Apr. 8, 2020, corresponding to Application No. PCT/NL2019/050667.

* cited by examiner

*Primary Examiner* — Chelsea E Stinson
(74) *Attorney, Agent, or Firm* — Patterson + Sheridan, LLP

(57) ABSTRACT

A system comprising a mandrel, a winding device for helically winding strips around the mandrel to form a base tube moving away from the mandrel at a tube speed, a strip suppling device for supplying the strips to the winding device, and a cutting device for cutting the base tube at a predetermined length to form the lengths of tube while the base tube is moving in a tube direction at the tube speed, and a method.

26 Claims, 25 Drawing Sheets

SYSTEM FOR PRODUCING LENGTHS OF TUBE COMPRISING HELICALLY WOUND STRIPS

FIELD OF THE INVENTION

Figure 1A:
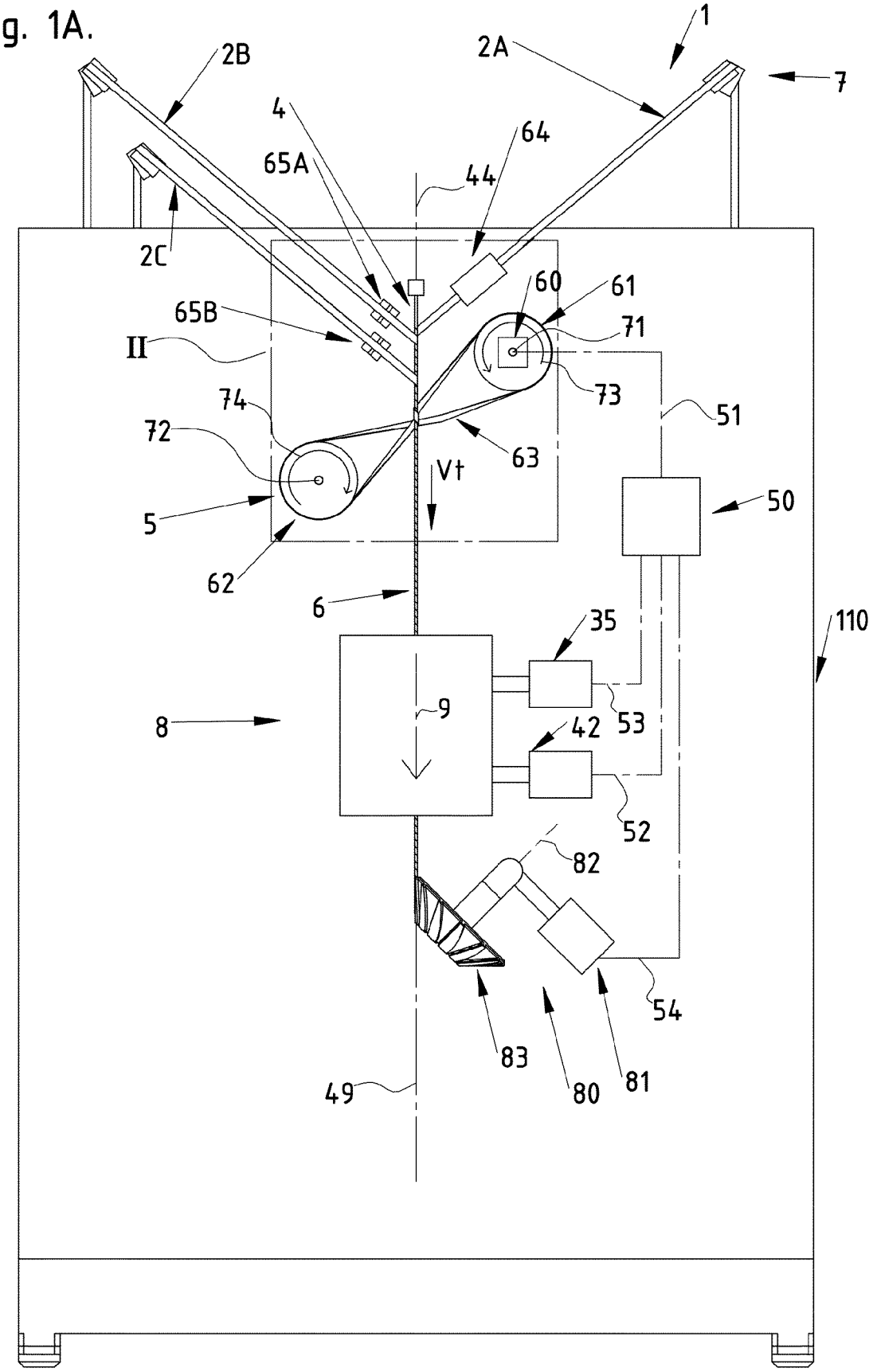

The invention relates to a system for producing lengths of tube, such as drinking straws, comprising helically wound strips. The system comprises a mandrel, a winding device for helically winding strips around the mandrel to form a base tube moving away from the mandrel at a tube speed, a strip suppling device for supplying the strips to the winding device, and a cutting device for cutting the base tube at a predetermined length to form the lengths of tube while the base tube is moving in a tube direction at the tube speed.

BACKGROUND OF THE INVENTION

The invention is based on the inside that the known system extends along a relatively large distance in the tube direction and/or operate relatively slow.

SUMMARY OF THE INVENTION

The invention has the objective to provide an improved (or at least alternative) system for producing lengths of tube, such as drinking straws, comprising helically wound strips. According to a further aspect, the invention has the objective to provide a system which is relatively shorter in the tube direction. According to a further aspect, the invention has the objective to provide a system which operates relatively faster.

For this reason, the system comprises a mandrel, a winding device for helically winding strips around the mandrel to form a base tube moving away from the mandrel at a tube speed, a strip suppling device for supplying the strips to the winding device, a cutting device for cutting the base tube at a predetermined length to form the lengths of tube while the base tube is moving in a tube direction at the tube speed, wherein the cutting device comprises a knife which is movable along a knife trajectory surrounding a centre axis and extending over a knife axial distance along the centre axis, the knife trajectory forms, when viewed in a direction of the centre axis, a virtual circle having a knife radius distance and a circle centre coinciding with the centre axis, the knife trajectory comprises a cutting part in which the knife is moved over the knife axial distance in the tube direction while, when viewed in the direction of the centre axis, moving along the virtual circle, the knife trajectory further comprises a retrieving part in which the knife is moved over the knife axial distance and opposite to the tube direction while, when viewed in the direction of the centre axis, moving along the virtual circle, the cutting device is configured to cut the base tube with the knife moving along the cutting part of the knife trajectory, the cutting device comprises a first displacement unit configured to displace the knife around the centre axis and, when viewed in the direction of centre axis, along the virtual circle, a second displacement unit configured to displace the knife over the knife axial distance in the tube direction and opposite thereto, and a knife displacement drive which is operatively coupled to the first displacement unit and the second displacement unit and configured to move the knife, when viewed in the direction of the centre axis, along the virtual circle at a rotational knife speed and to move the knife over at least part of the knife axial distance in the tube direction at an axial knife speed equal to the tube speed when the knife moves along the cutting part of the knife trajectory and cuts the base tube.

In this system, the knives of the cutting device extend over a relatively short distance in the tube direction. As a result, the system is relatively shorter in the tube direction.

In an embodiment according to the system, the cutting device comprises a counterweight which is movable along the knife trajectory or at a counterweight trajectory at a constant counterweight distance from the knife trajectory to balance the movement of the knife along the trajectory.

In an embodiment according to the system, the counterweight is a further knife which is movable along the knife trajectory and configured to cut the base tube.

In an embodiment according to the system, the cutting device comprises multiple knives which are movable along the knife trajectory to cut the base tube and the first displacement unit and the second displacement unit are configured to continuously displace a same number of knives along the cutting part of the knife trajectory as displaced along the retrieving part of the knife trajectory.

In an embodiment according to the system, the knives are, when viewed in the direction of the centre axis, located at an equal distance from each other along the virtual circle.

In an embodiment according to the system, the cutting device comprises an even number of knives.

In an embodiment according to the system, the cutting part and the retrieving part of the knife trajectory are, when viewed in the direction of the centre axis, located at opposite sides of the virtual circle.

In an embodiment according to the system, the cutting part of the knife trajectory has a cutting part length, the retrieving part of the knife trajectory has a retrieving part length, and the retrieving part length is equal to the cutting part length.

In an embodiment according to the system, the second displacement unit is configured to move the knife at an axial knife speed equal to the tube speed and opposite to the tube direction when the knife moves along the retrieving part of the knife trajectory.

In an embodiment according to the system, the cutting part of the knife trajectory starts at a cutting part starting position on the knife trajectory and ends at a cutting part ending position on the knife trajectory, the retrieving part of the retrieving trajectory starts at a retrieving part starting position on the knife trajectory and ends at a retrieving part ending position on the knife trajectory, the retrieving part ending position and cutting part starting position coincide, and the cutting part ending position and the retrieving part starting position coincide.

In an embodiment according to the system, the knife trajectory has, when viewed in a transverse direction extending perpendicular to the centre axis, an oval-like shape.

In an embodiment according to the system, the first displacement unit comprises a knife support holding the knife at the knife radius distance from the centre axis, while allowing movement of the knife over the knife axial distance parallel to the centre axis, the first displacement unit is configured to rotate the knife support around the centre axis, while holding the knife at the knife radius distance from the centre axis, and the second displacement unit comprises a cam coupled to the knife and a cam track configured to displace the knife over the knife axial distance parallel to the centre axis in the tube direction when the knife moves along the cutting part of the knife trajectory and to move the knife over the knife axial distance parallel to the centre axis and opposite to the tube direction when the knife move along the retrieving part of the knife trajectory.

In an embodiment according to the system, the knife is a rotating knife having a rotation axis extending parallel to the centre axis.

In an embodiment according to the system, the knife is operatively attached to a knife rotation gear wheel surrounding the rotation axis of said knife, the cutting device comprises a knife rotation gear ring engaging the knife rotation gear wheel of the knife and having a knife rotation ring centre coinciding with the centre axis, and the knife rotation gear wheel and the knife rotation gear ring cooperate to rotate the knife about its rotation axis when the knife is, when viewed in the direction of the centre axis, moved along the virtual circle.

In an embodiment according to the system, knife rotation gear ring is rotatable about the knife rotation ring centre and the cutting device comprises a knife rotation drive configured to rotate the knife rotation gear ring about the knife rotation ring centre in order to control a rotational cutting speed with which the knife rotates around its rotation axis.

In an embodiment according to the system, the cutting device is configured to move the knife through only part of the base tube when the knife is moved along the cutting part of the knife trajectory.

In an embodiment according to the system, the winding device is configured to rotate the base tube around the mandrel.

In an embodiment according to the system, the system comprises a tube support configured to hold the base tube in the knife trajectory.

In an embodiment according to the system, the tube direction is parallel to the centre axis.

In an embodiment according to the system, the base tube comprises a longitudinal tube axis extending parallel to the centre axis.

In an embodiment according to the system, the mandrel comprises a longitudinal mandrel axis extending in line with the tube direction.

In an embodiment according to the system, the strip supplying device is configured to supply paper strips and the winding device is configured to helically wind the paper strips around the mandrel.

In an embodiment according to the system, the strip supplying device is configured to supply only paper strips.

In an embodiment according to the system, the system comprises a controller having a first communication connection with the winding device and a second communication connection with the knife displacement drive, and the controller is configured to control the tube speed with which the base tube moves away from the mandrel and the rotational knife speed with which the knife is, when viewed in direction of the centre axis, moved along the virtual circle.

In an embodiment according to the system, the controller comprises a third communication connection with the knife rotation drive and the controller is configured to control the rotational cutting speed with which the knife rotates around its rotation axis by adjusting the rotation of the knife rotation gear ring about the knife rotation ring centre.

In an embodiment according to the system, the cutting device is configured to move a cutting area of the knife (or the knives) along the knife trajectory.

It will be clear that any combination of the features of any number of the above defined embodiments of the system can be made.

The invention further relates to a method for producing lengths of tube, such as drinking straws, with a system according to the invention, said method comprising supplying strips with the strip supplying device to the winding device and helically winding said strips around the mandrel to form a base tube moving away from the mandrel at a tube speed, cutting the base tube at a predetermined length with the cutting device while the base tube is moving in a tube direction at the tube speed and the knife of the cutting device is moved along the cutting part of the knife trajectory, and driving the first displacement unit and the second displacement unit with the knife displacement drive to move the knife, when viewed in the direction of the centre axis, along the virtual circle at a rotational knife speed and to move the knife over at least part of the knife axial distance in the tube direction at an axial knife speed equal to the tube speed when the knife moves along the cutting part of the knife trajectory and cuts the base tube.

BRIEF DESCRIPTION OF THE INVENTION

Figure 1B:
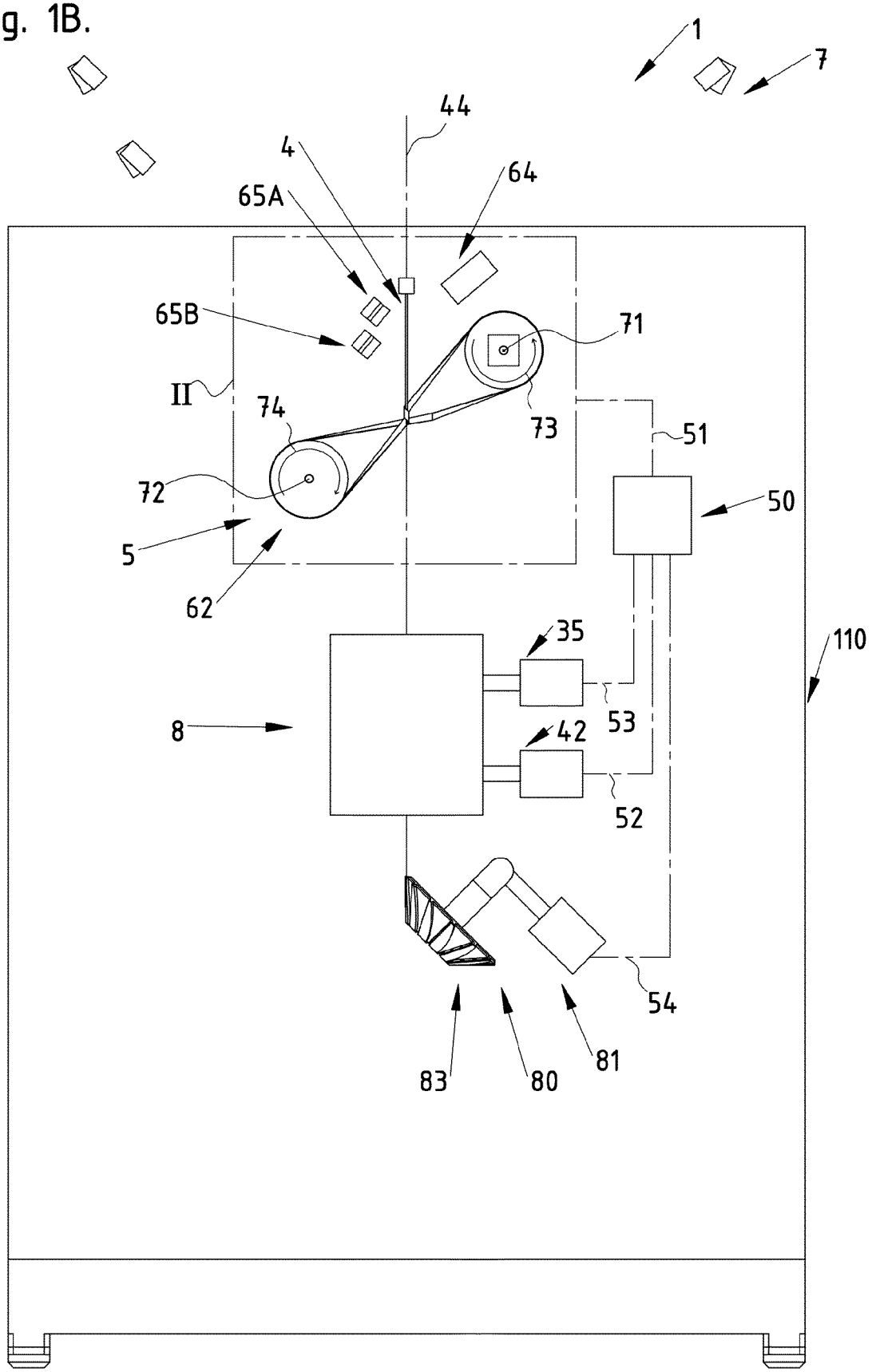
Figure 2:
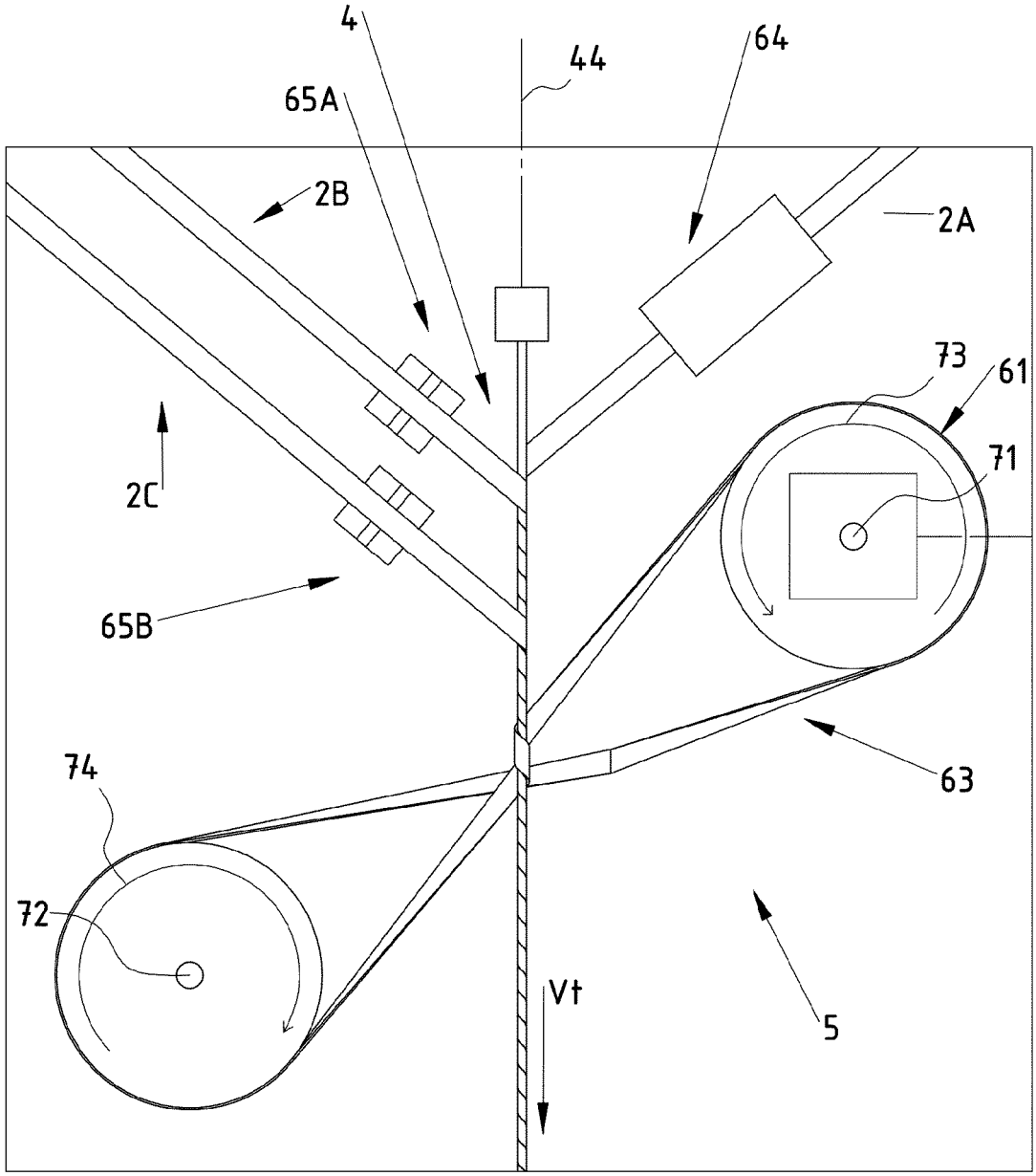
Figure 3A:
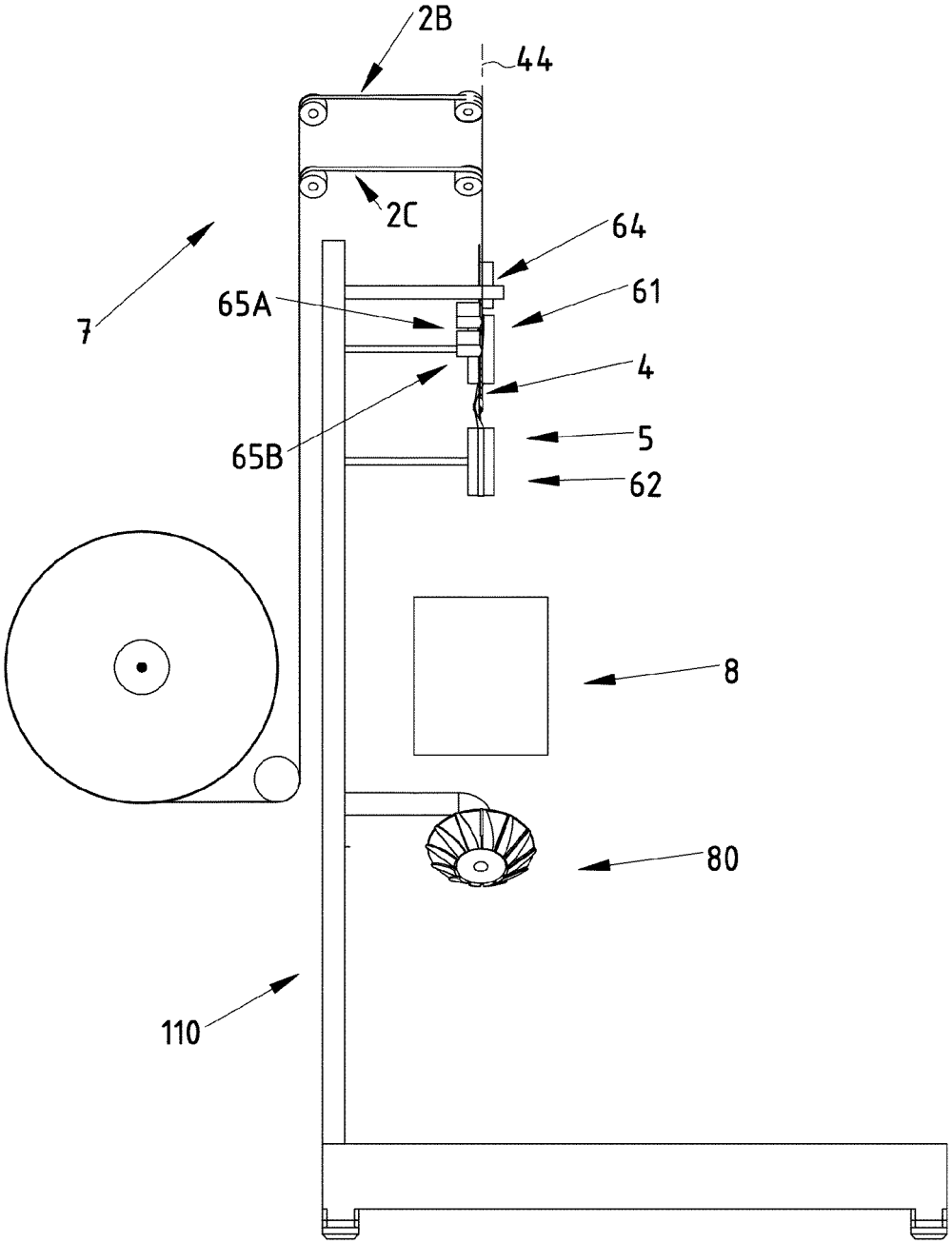
Figure 3B:
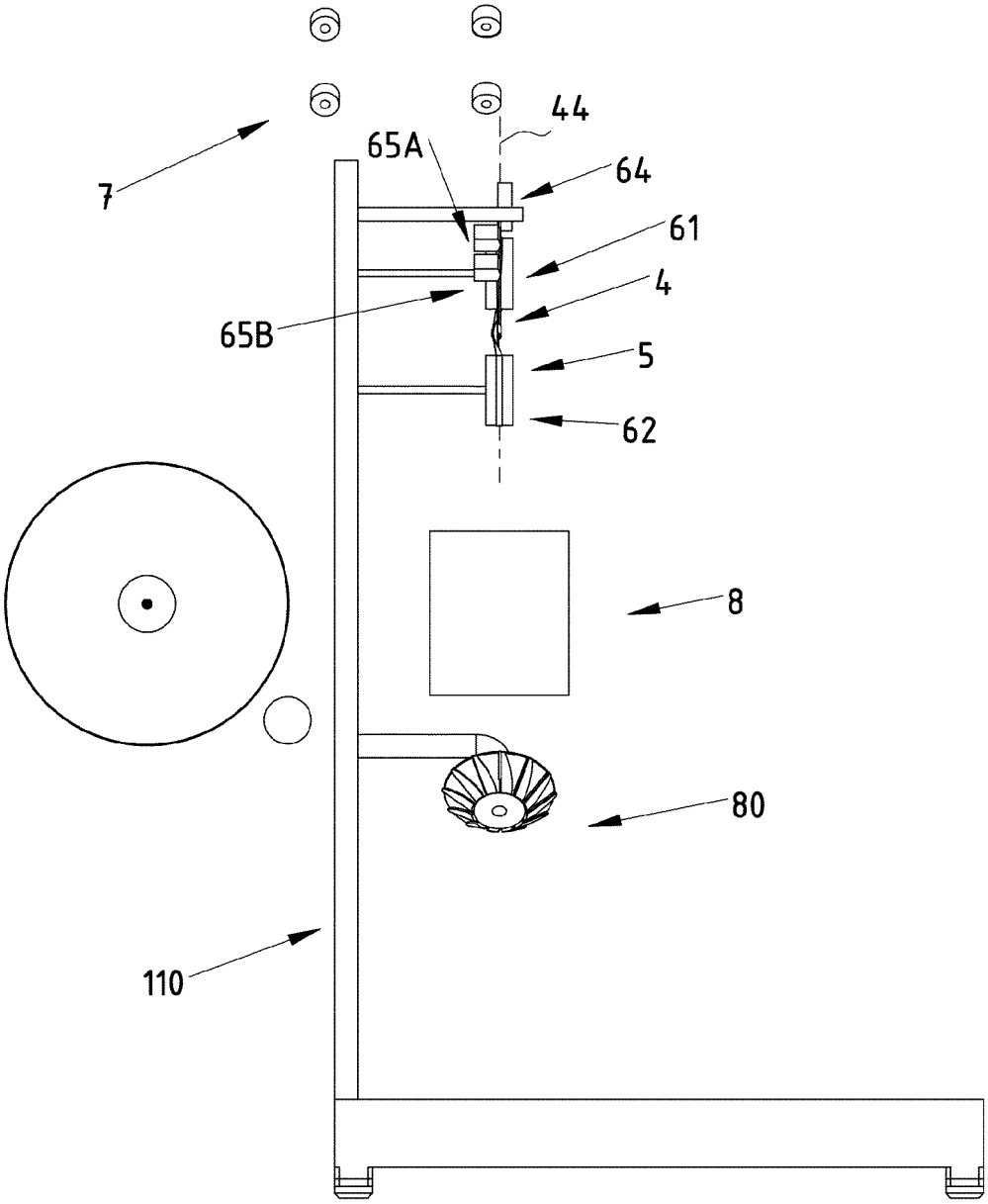
Figure 4:
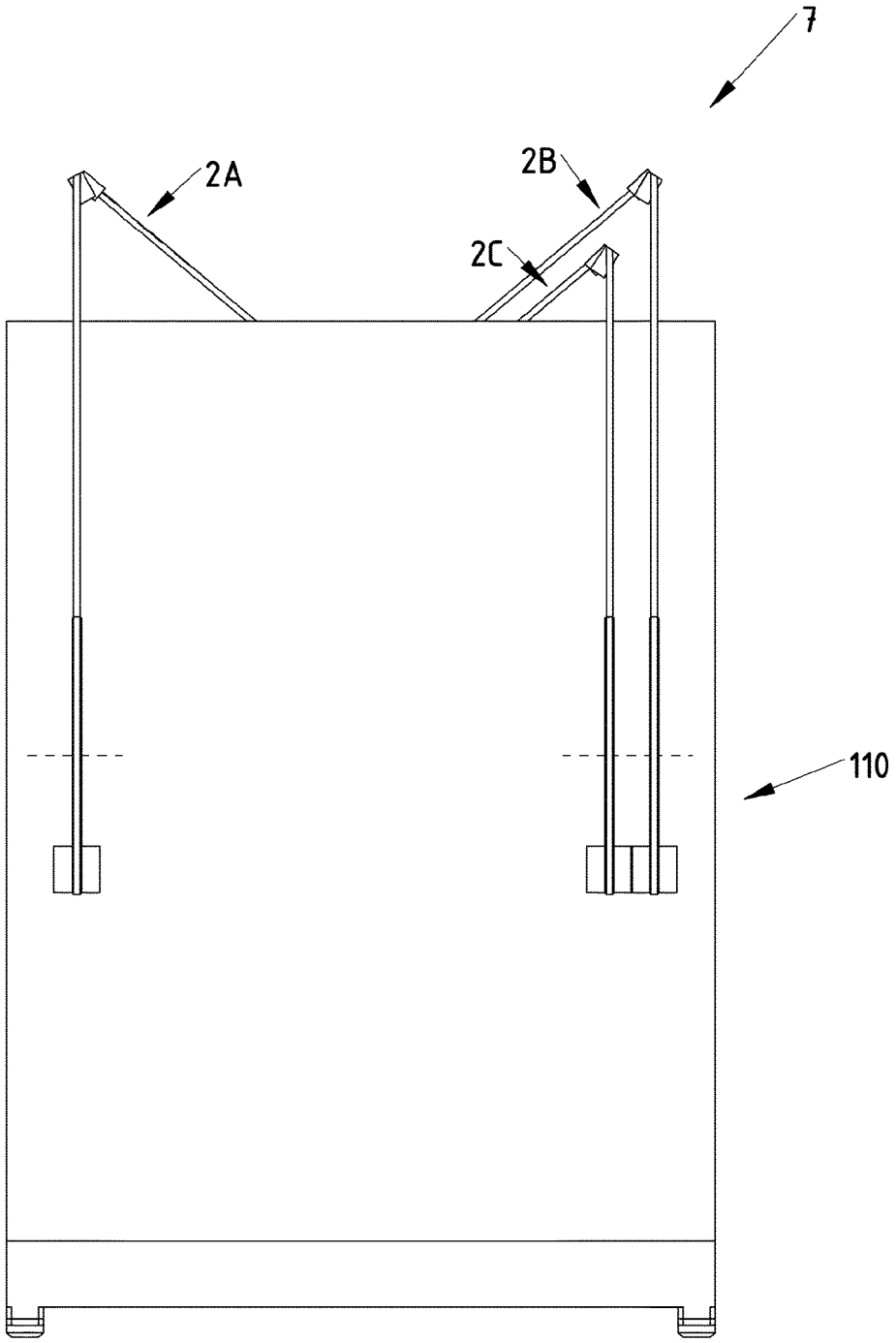
Figure 5:
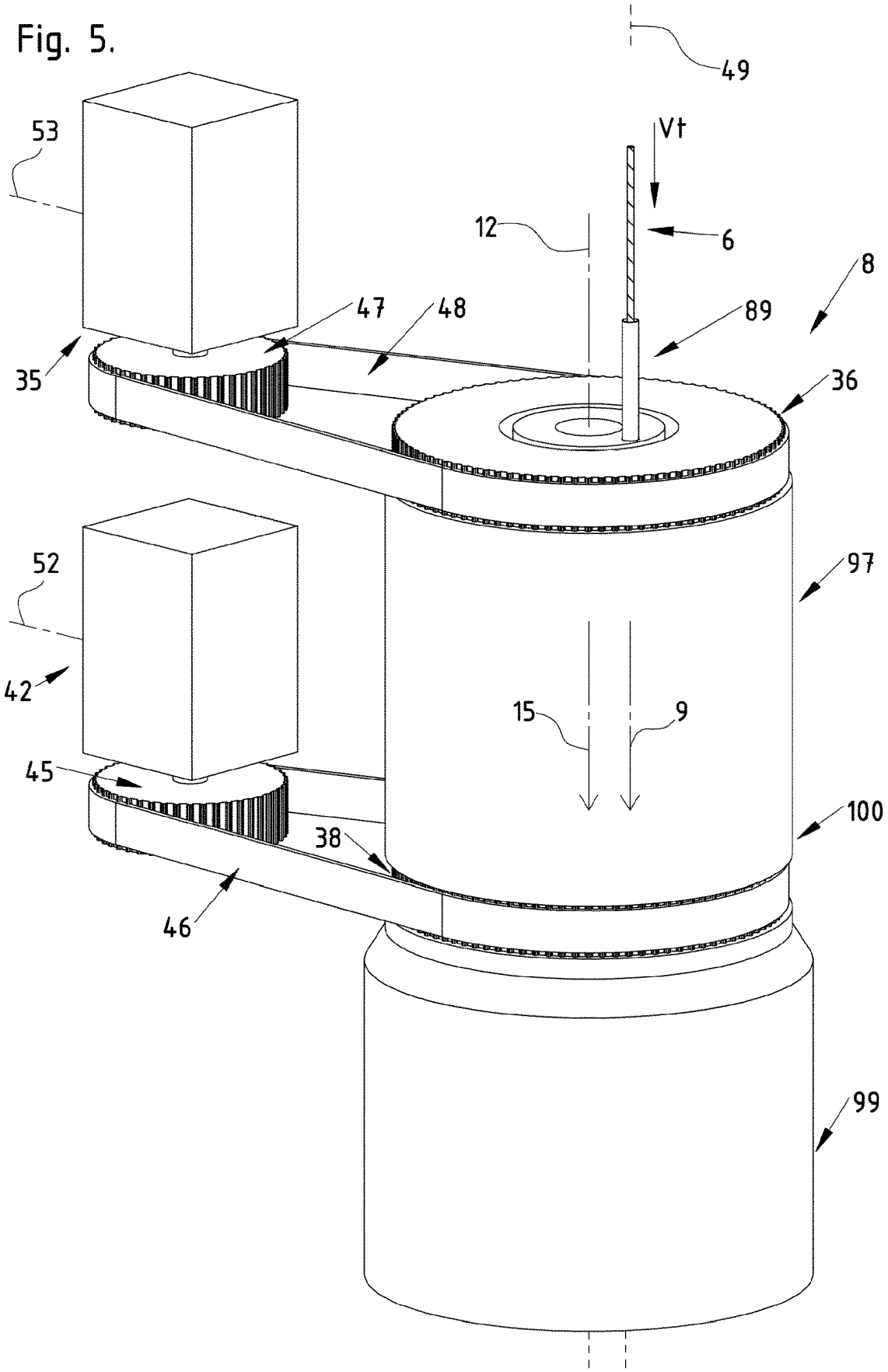
Figure 6:
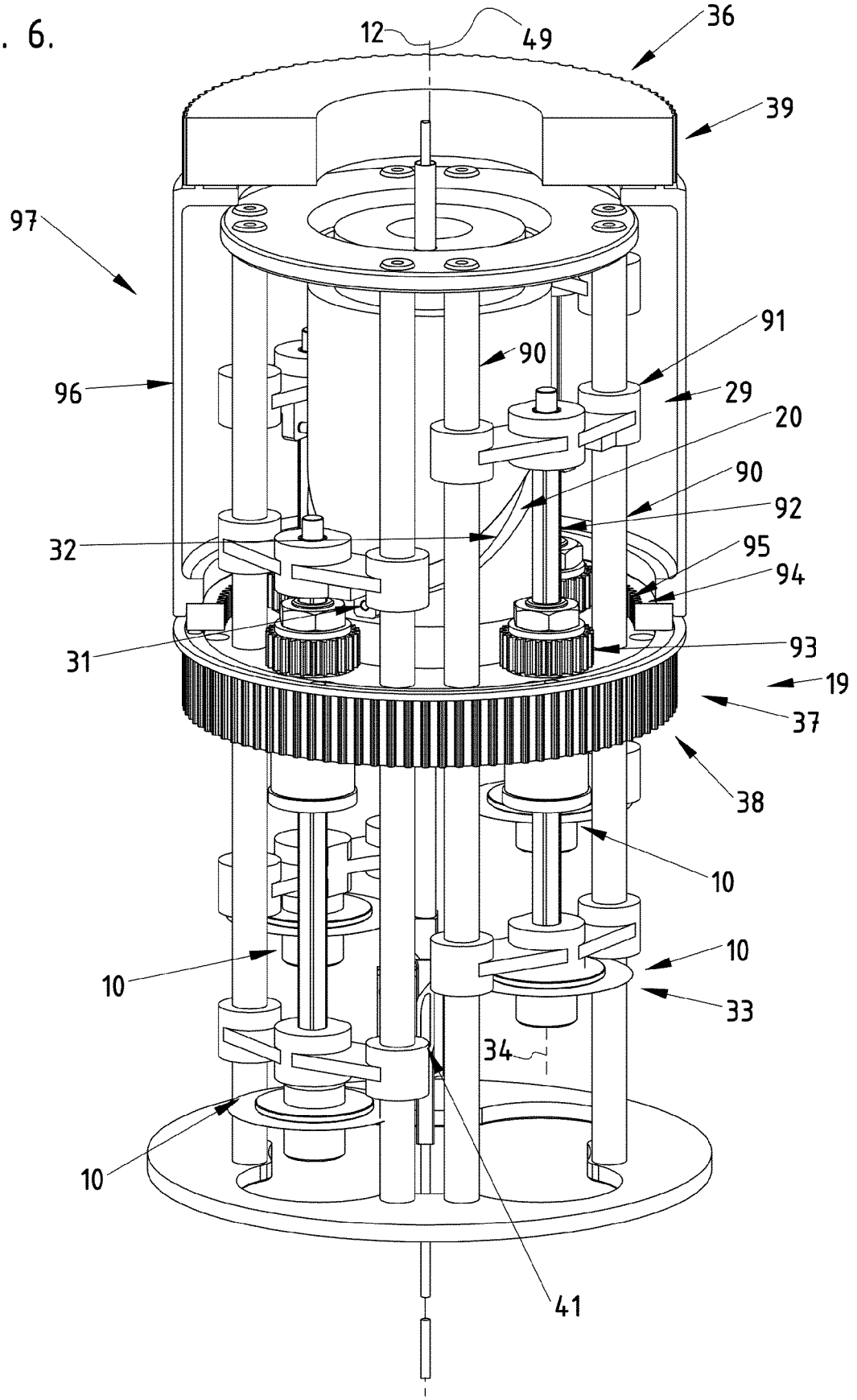
Figure 7:
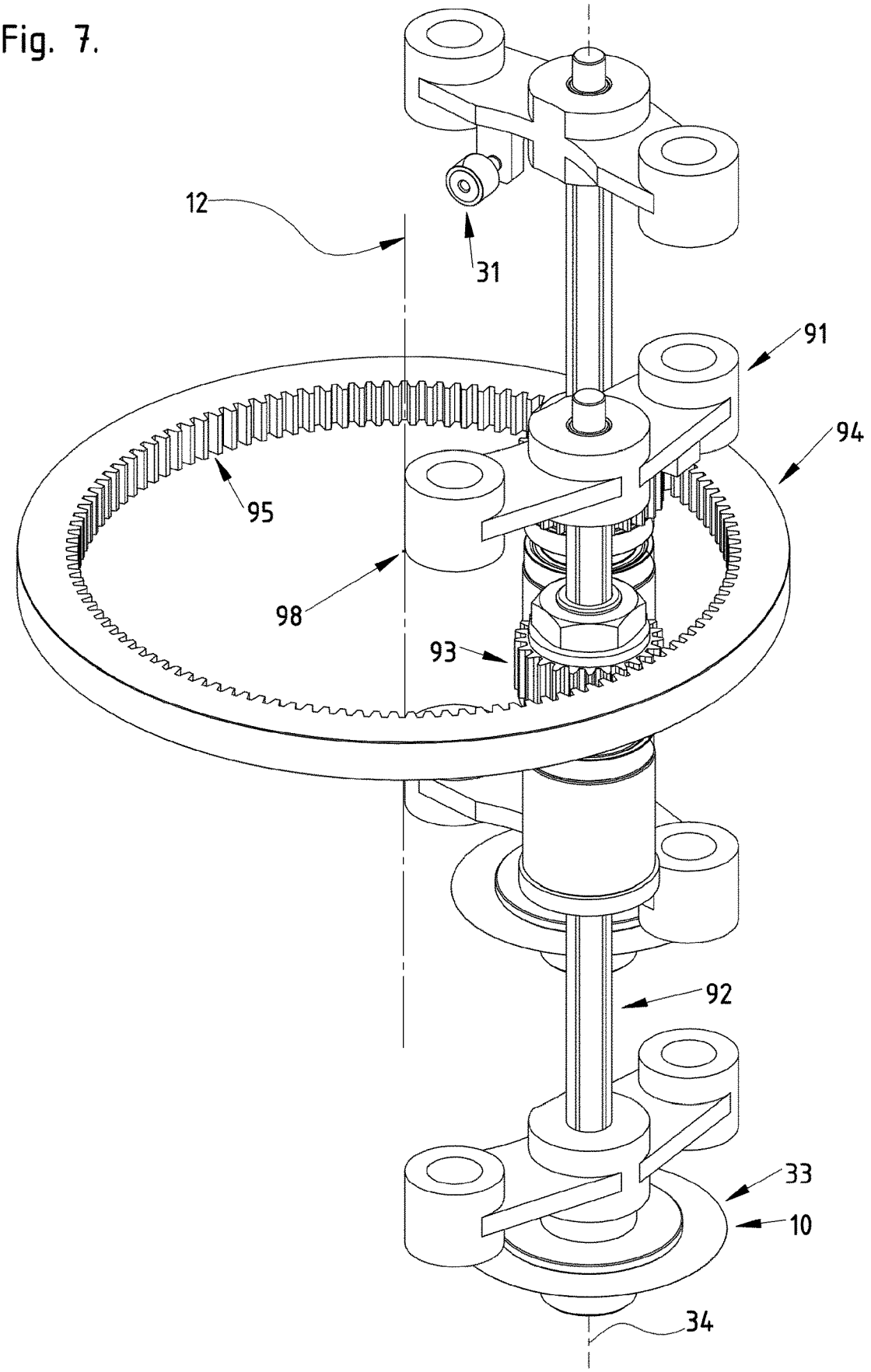
Figure 8:
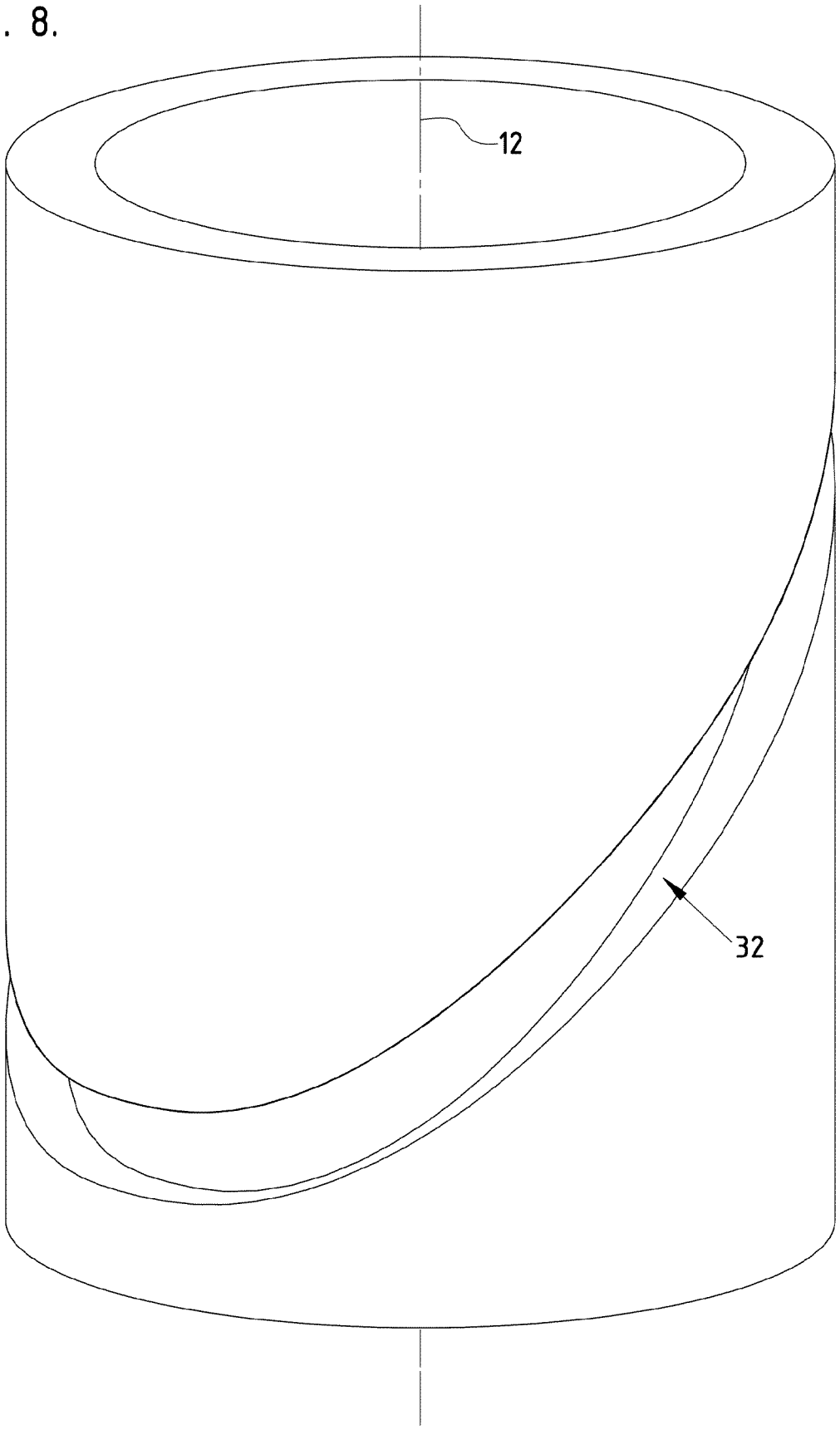
Figure 9A:
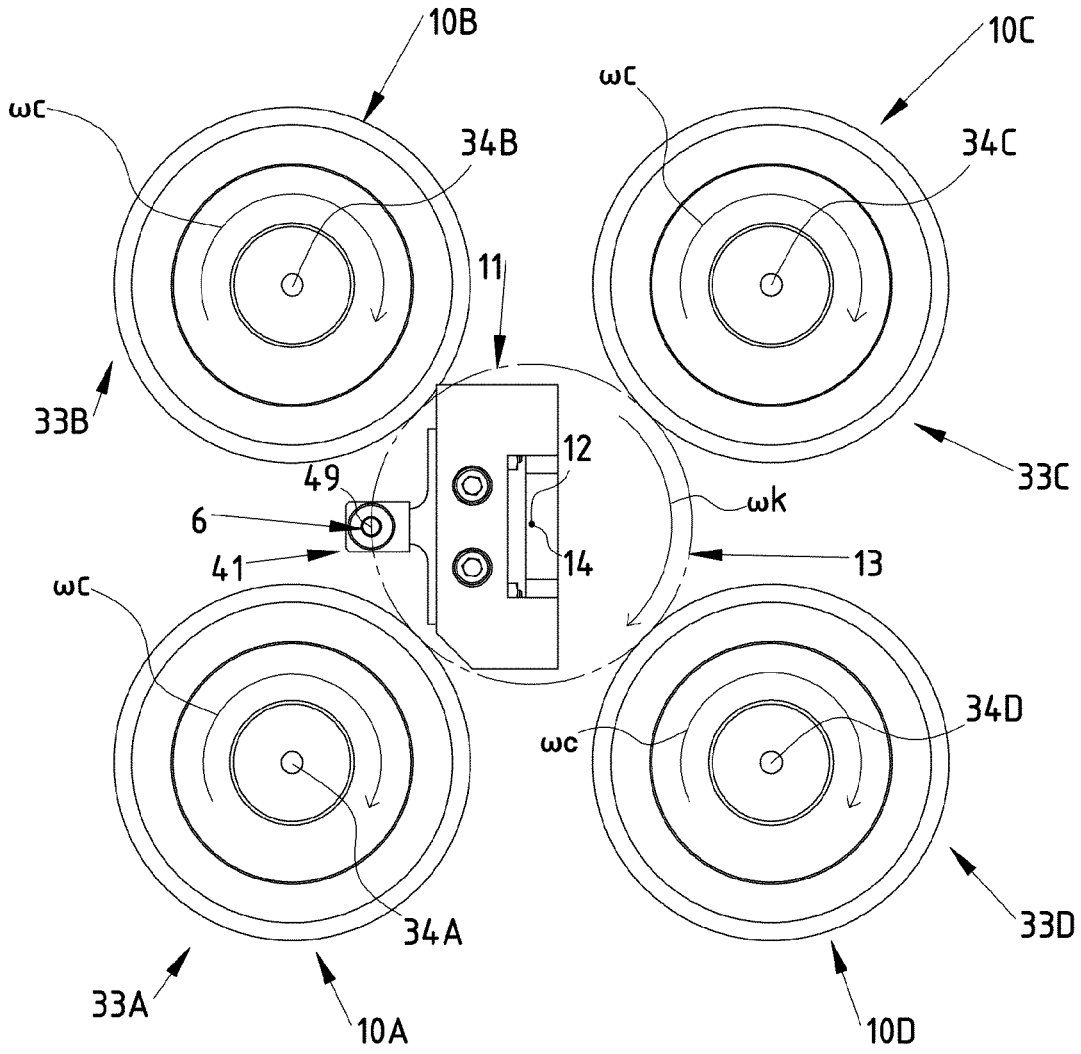
Figure 9B:
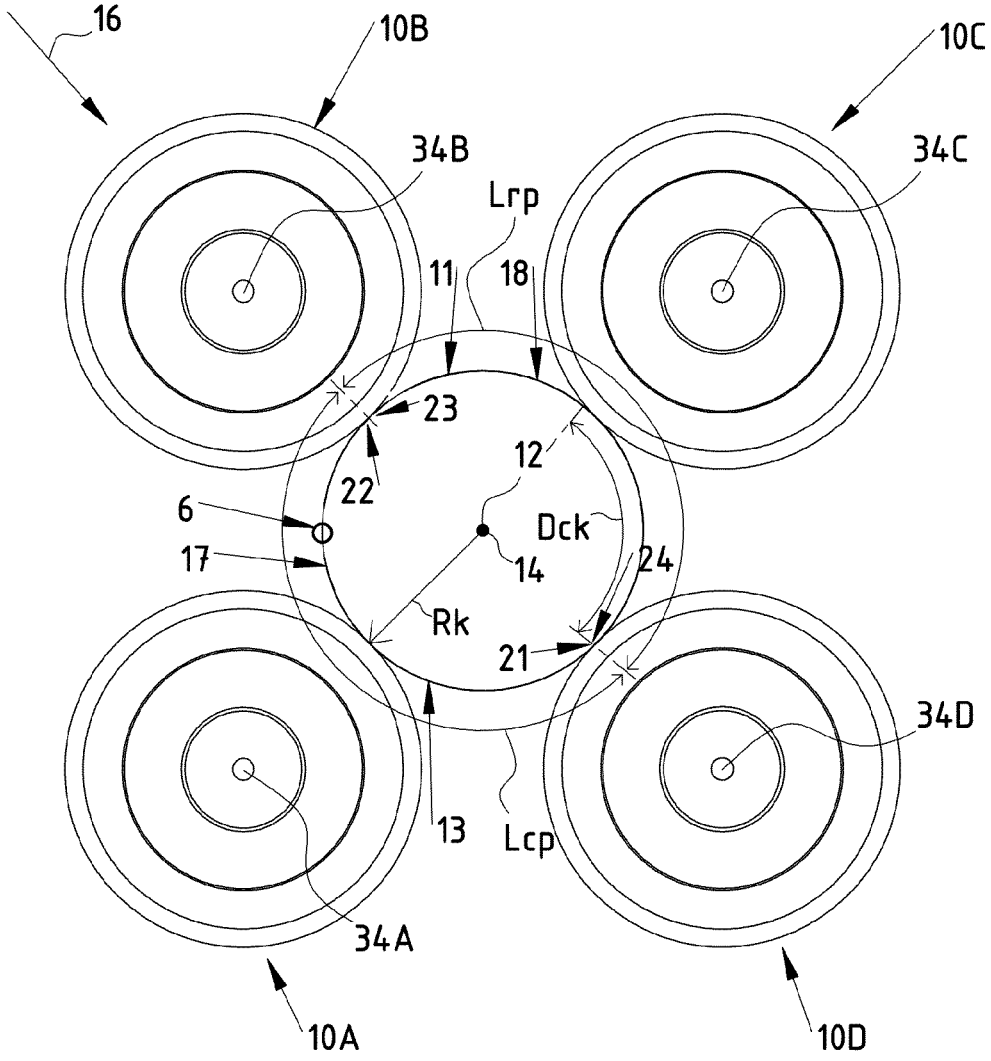
Figure 10:
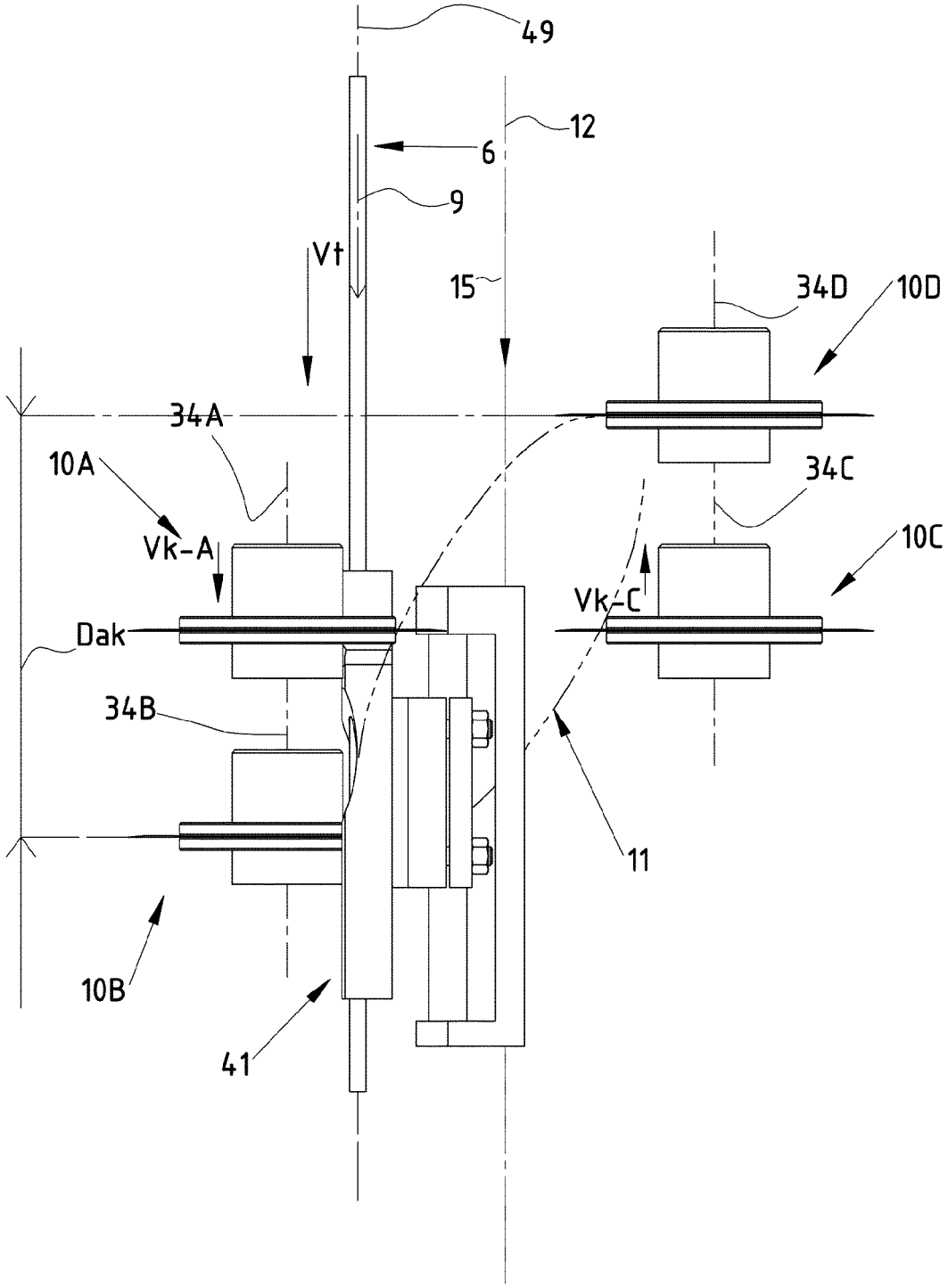
Figure 11:
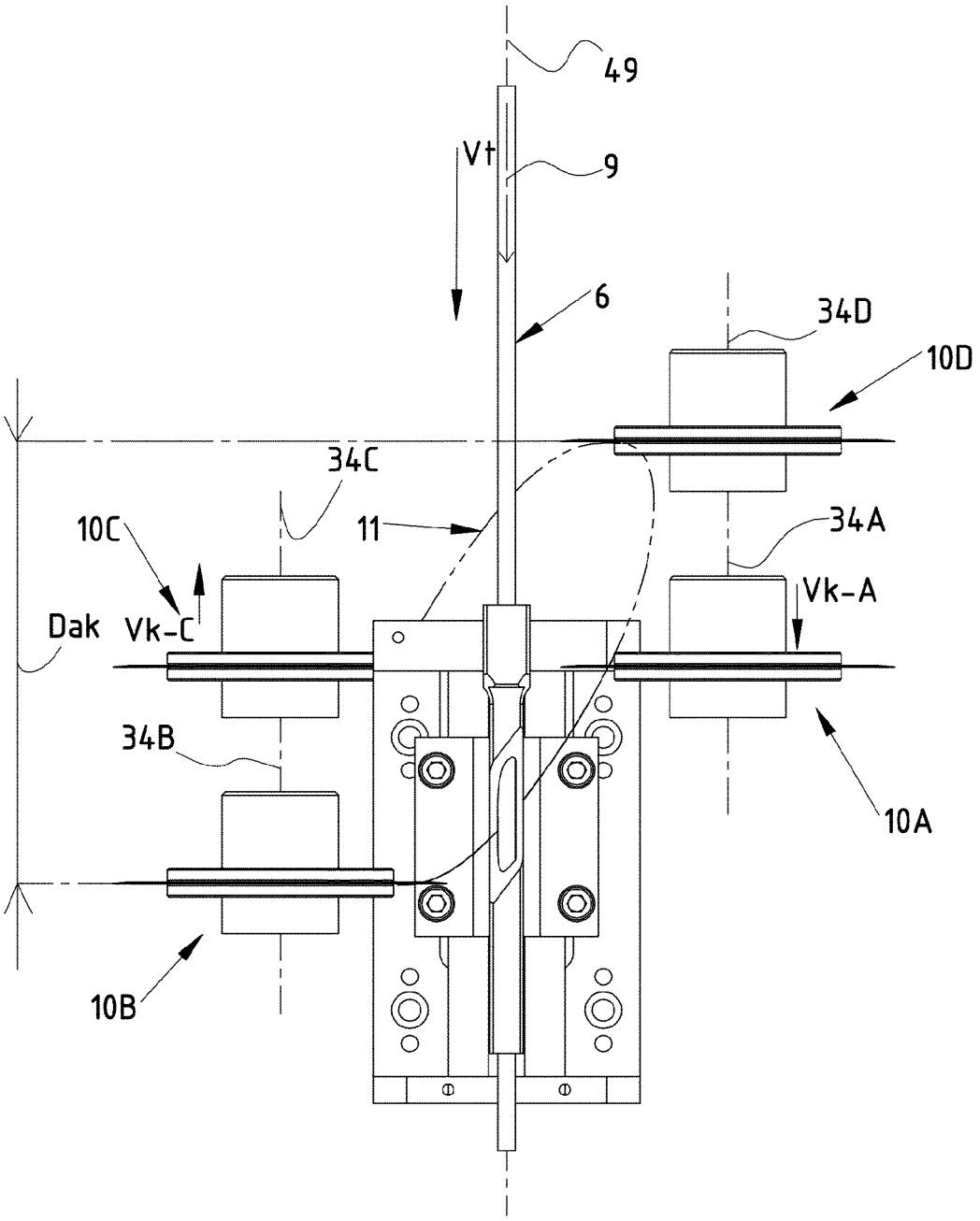
Figure 12A:
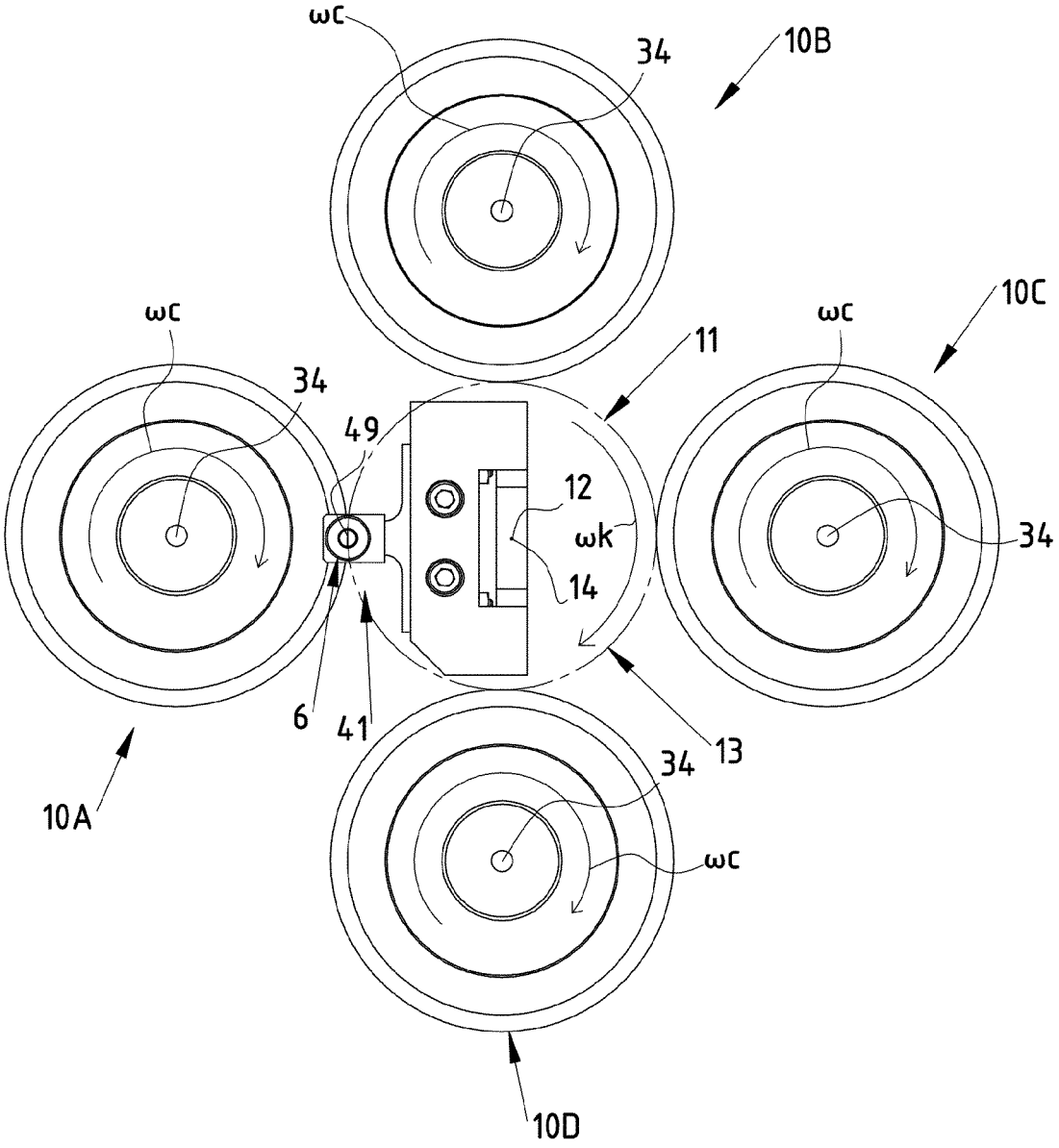
Figure 12B:
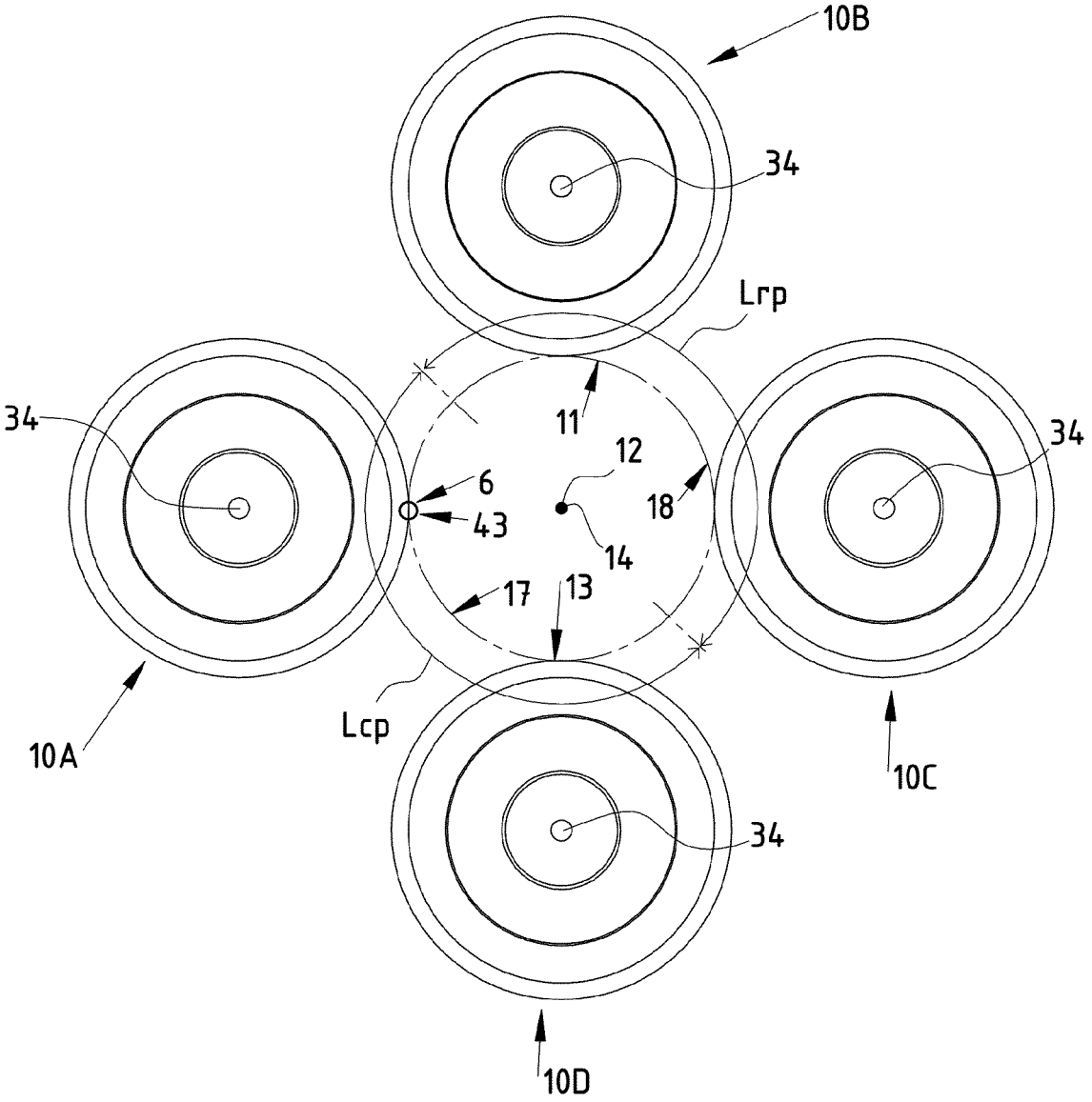
Figure 13A:
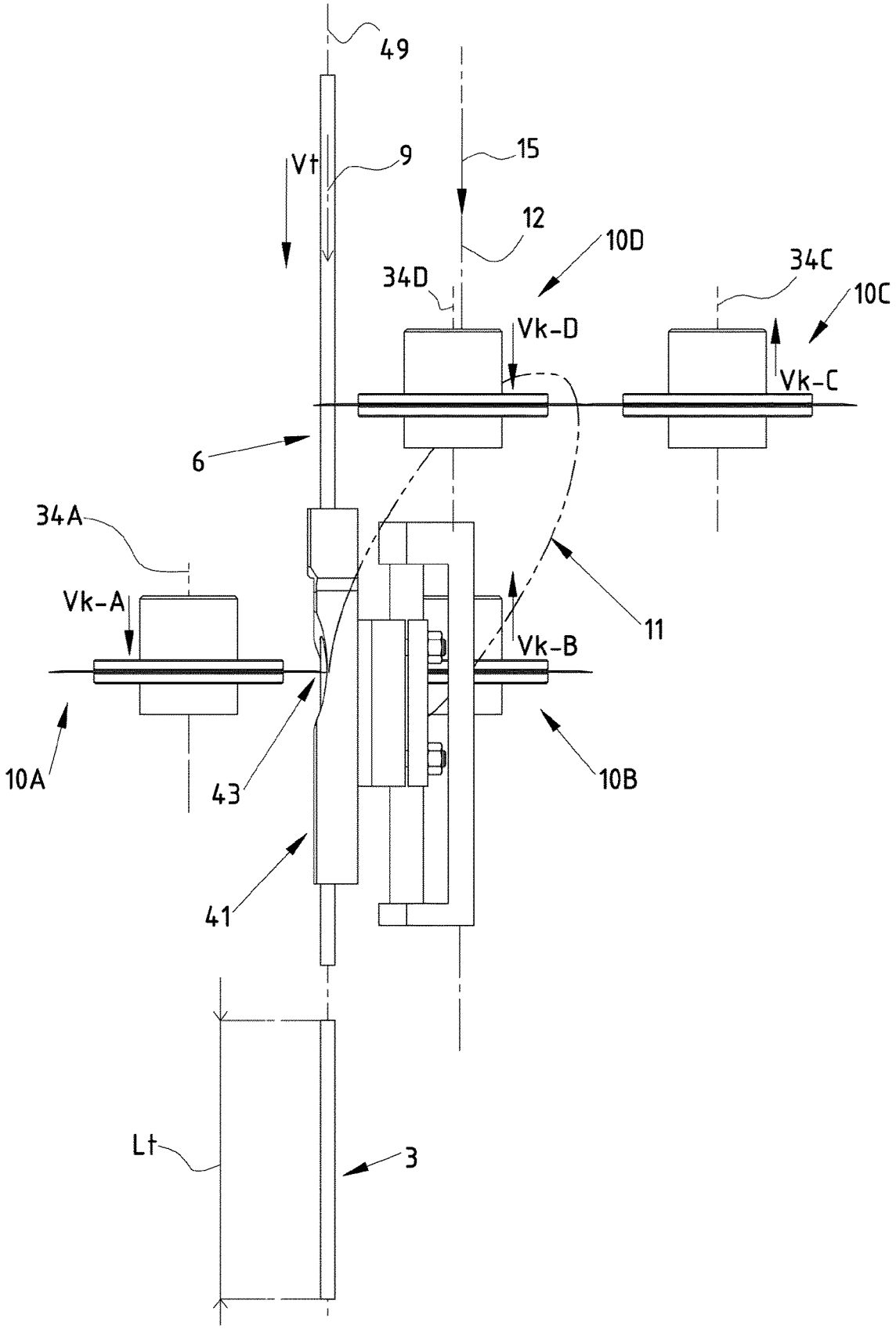
Figure 13B:
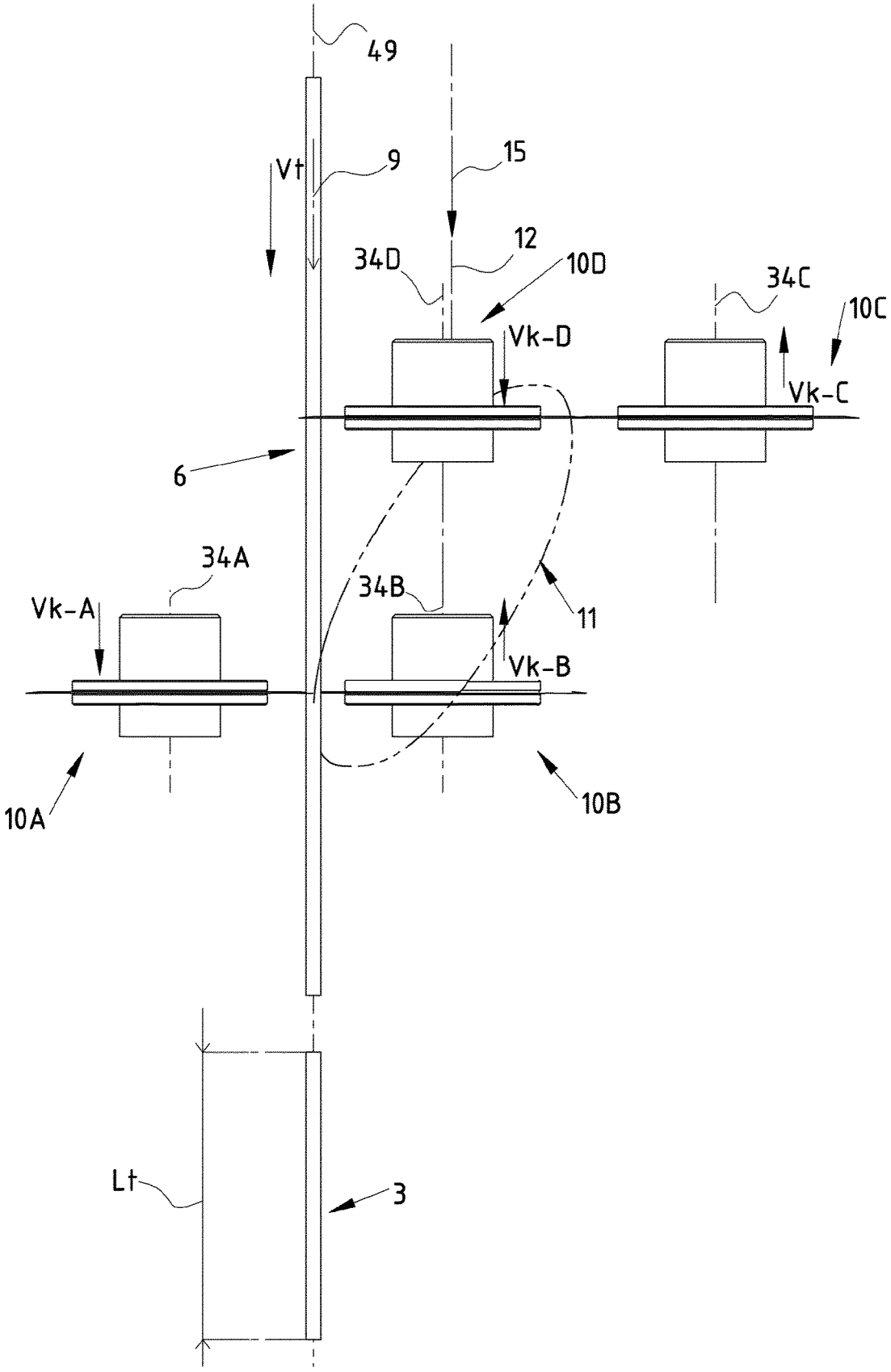
Figure 14A:
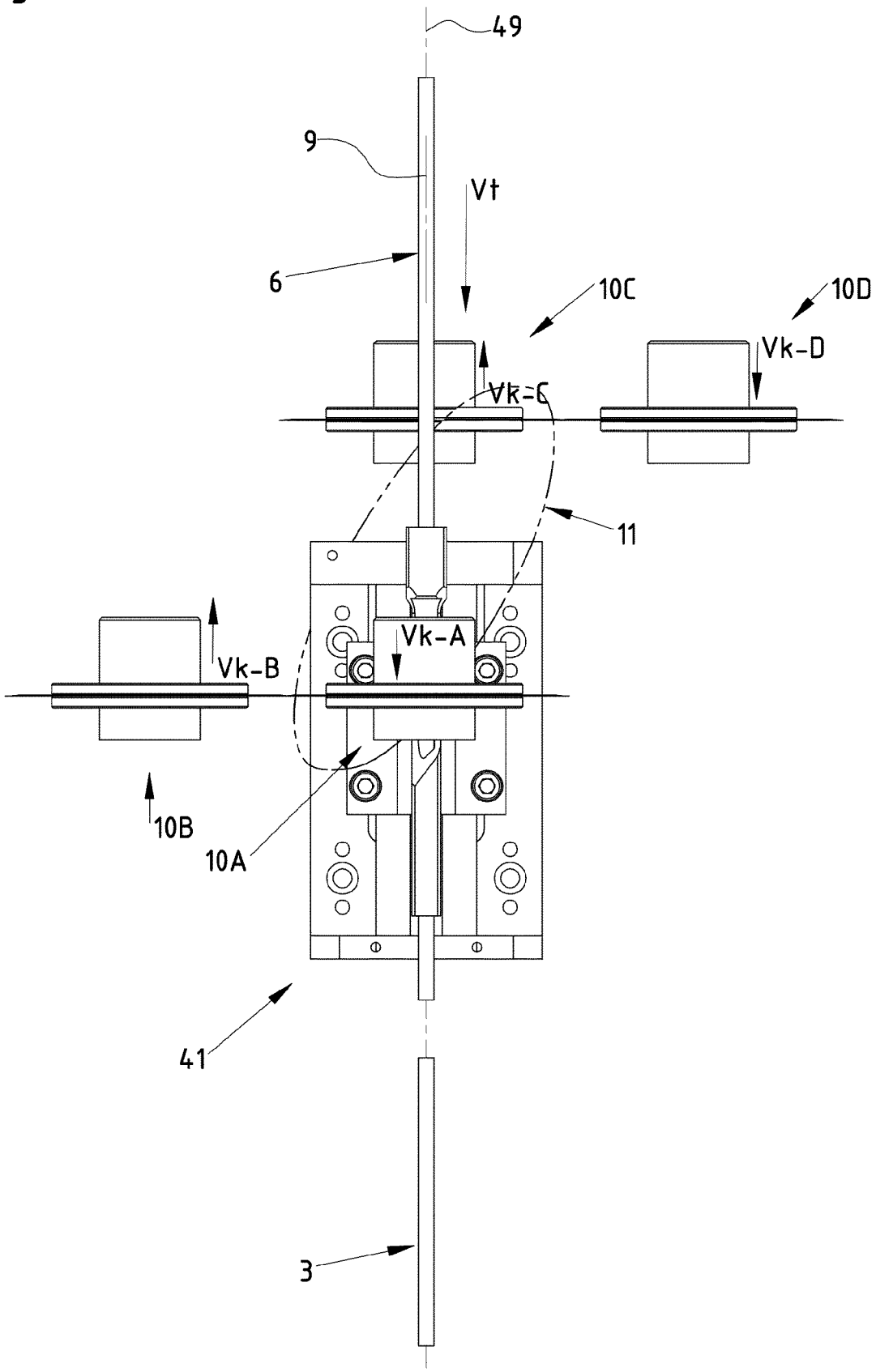
Figure 14B:
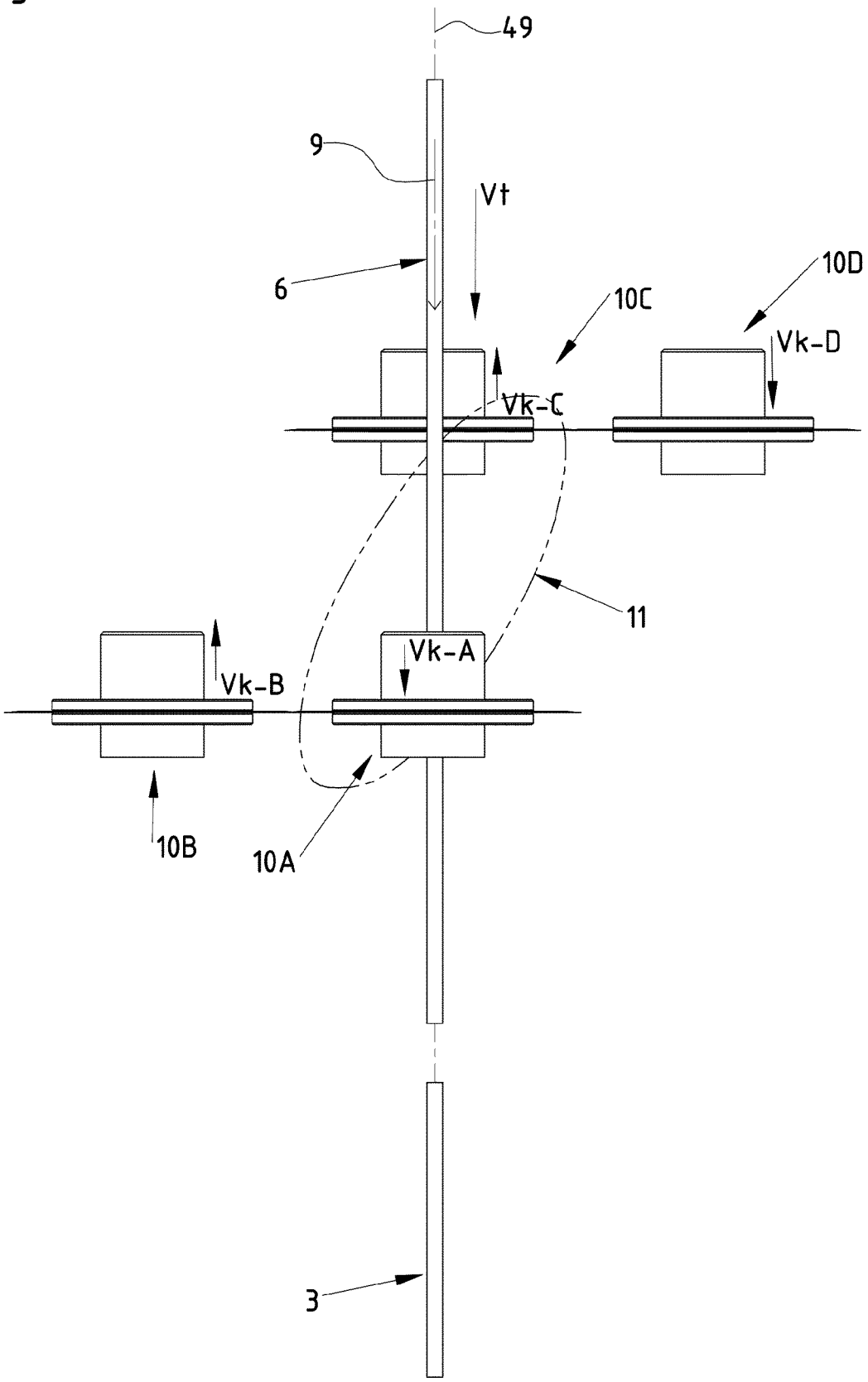
Figure 15A:
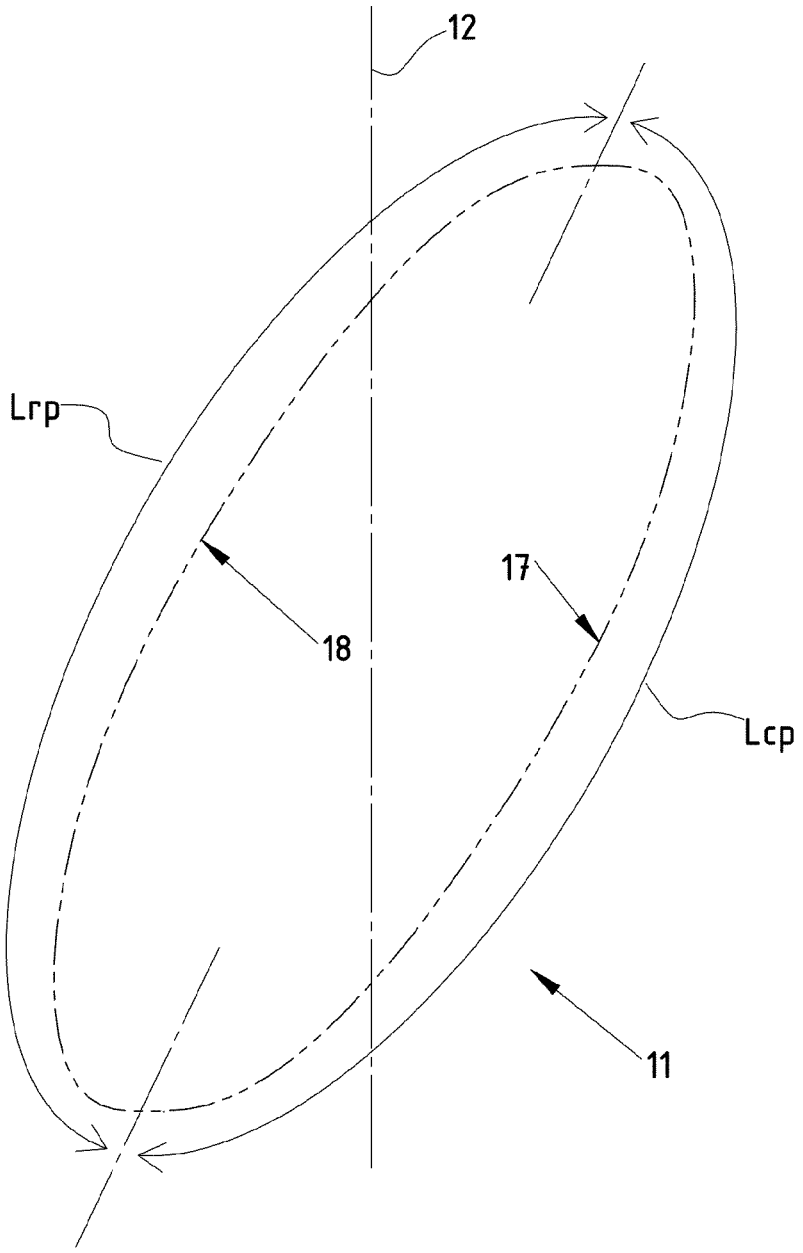
Figure 15B:
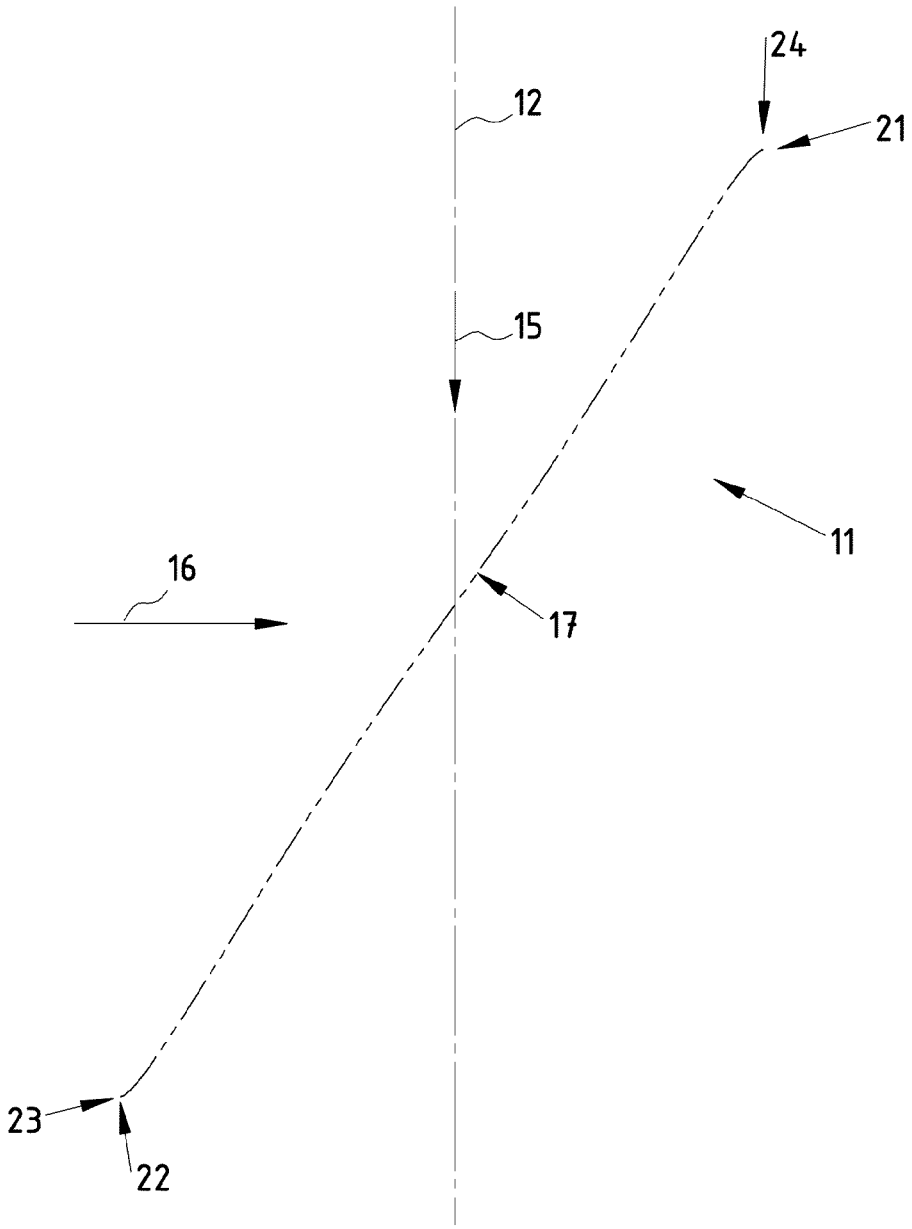
Figure 15C:
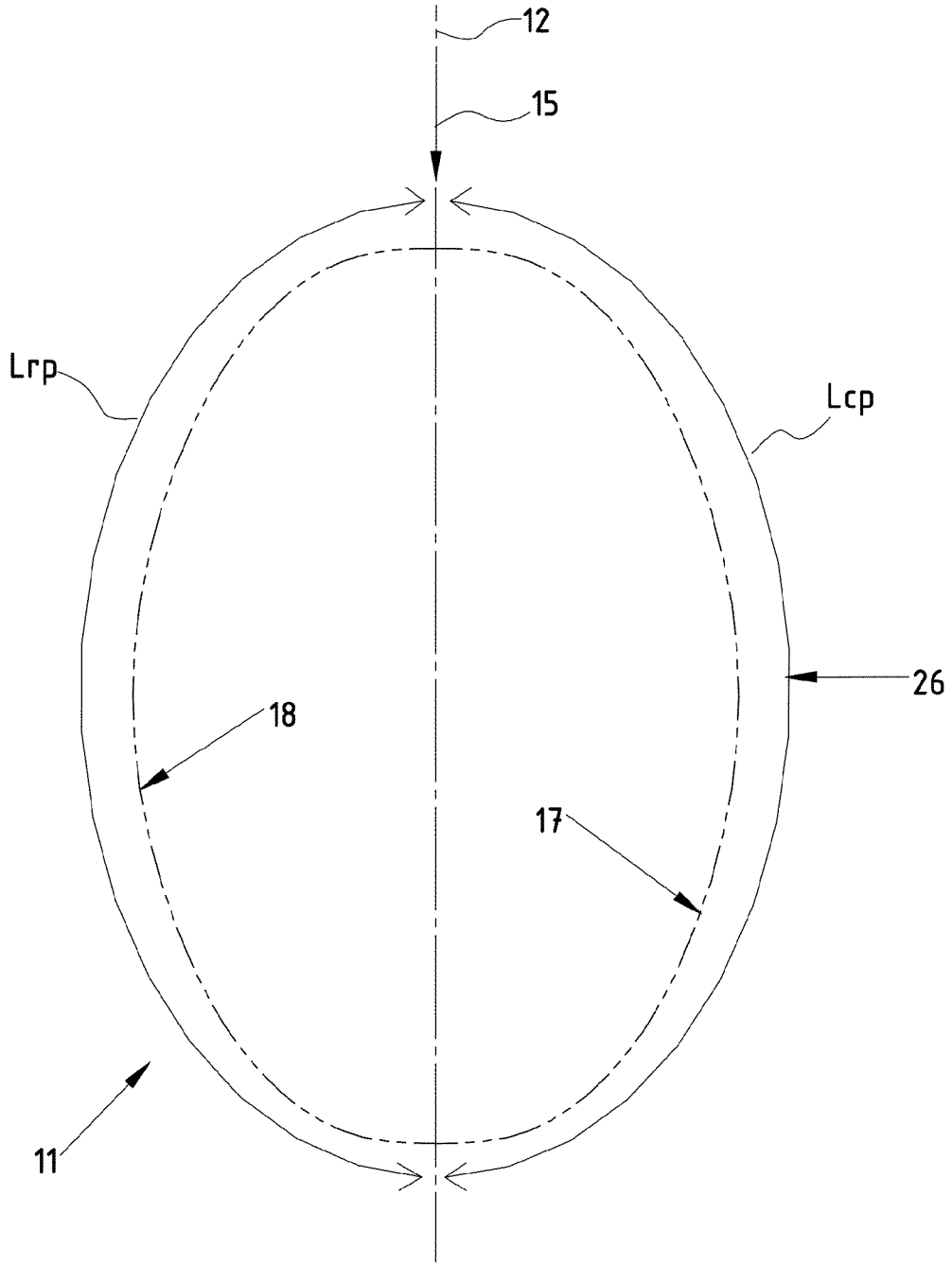
Figure 16:
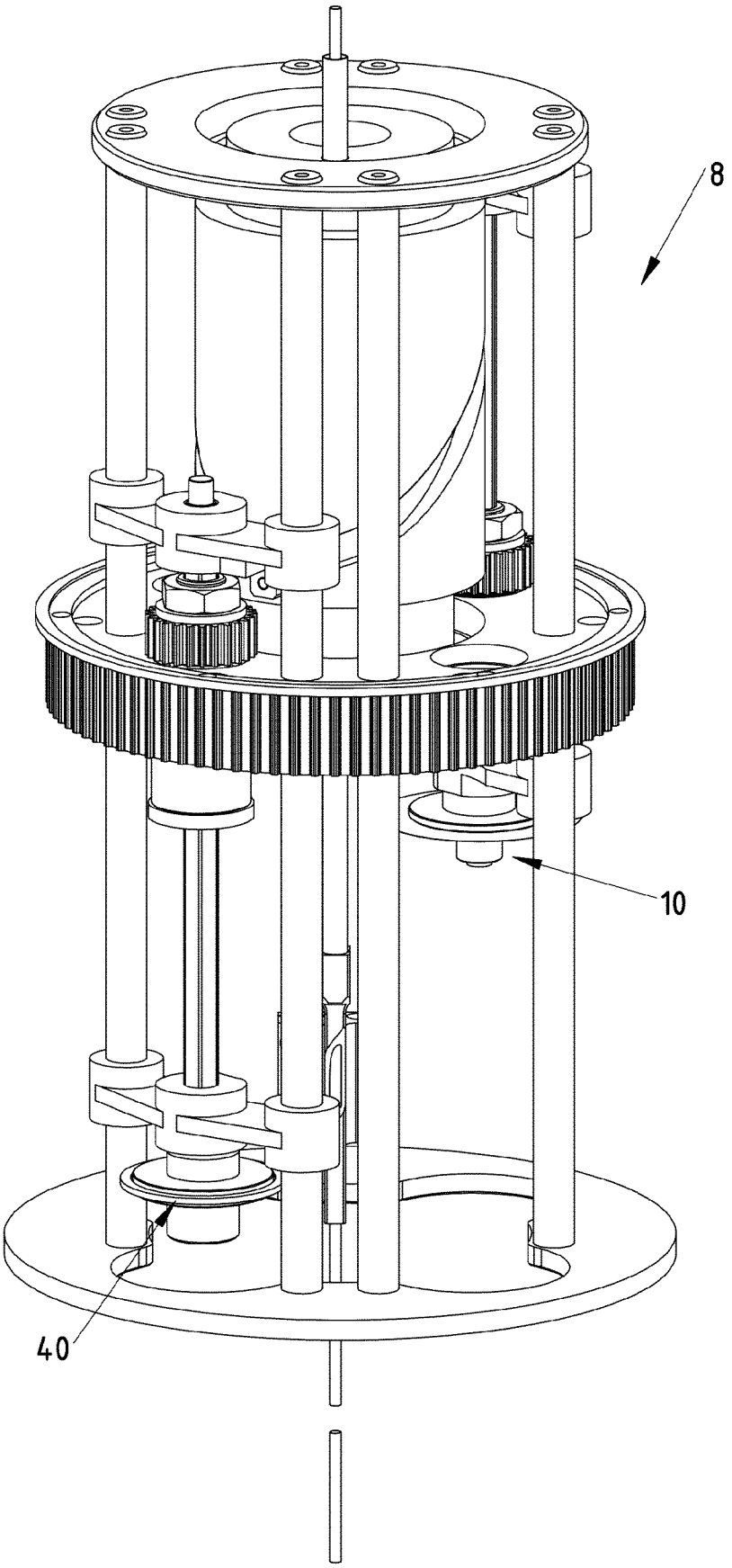
Figure 17:
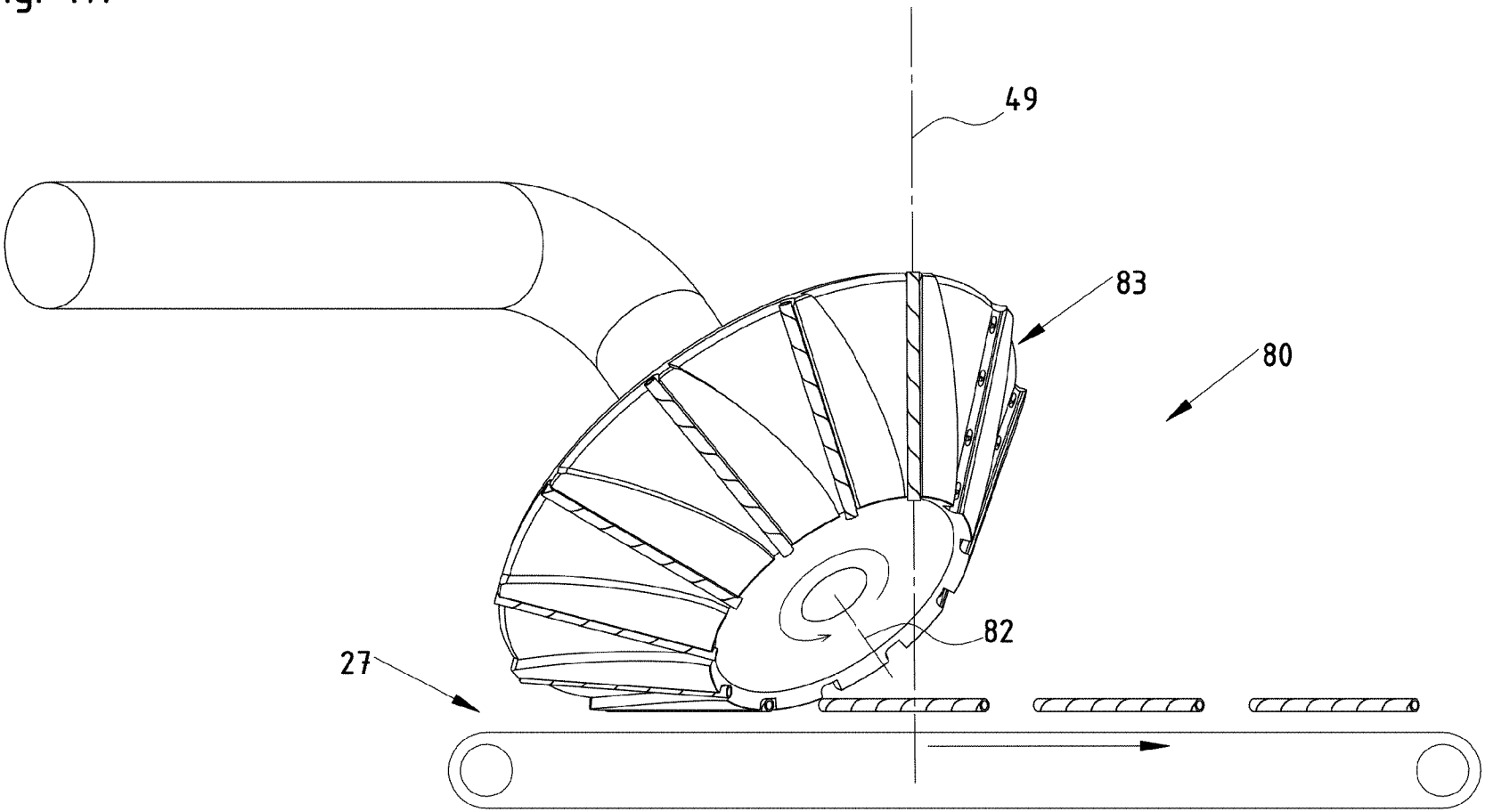

Embodiments of the system and method according to the invention will be described by way of example only, with reference to the accompanied schematic drawings in which corresponding reference symbols indicate corresponding parts, and in which;

FIG. 1A schematically shows a front view of an embodiment of the system according to the invention, FIG. 1B schematically shows the front view of FIG. 1A without the strips and the base tube, FIG. 2 schematically shows an enlarged view of part II of FIG. 1A, FIG. 3A schematically shows a side view of the system of FIG. 1A, FIG. 3B schematically shows the view of FIG. 3A without the strips and the base tube, FIG. 4 schematically shows a rear view of the system of FIG. 1A, FIG. 5 schematically shows a view in perspective of the cutting device of the system of FIG. 1A, FIG. 6 schematically shows a view in perspective of the inside of the cutting device of FIG. 5, FIG. 7 schematically shows a view in perspective of internal parts of the cutting device of FIG. 5, FIG. 8 schematically shows a view in perspective of further internal parts of the cutting device of FIG. 5, FIG. 9A schematically shows a top view in the direction of the centre axis of the knives and tube support of the cutting device of FIG. 5, FIG. 9B schematically shows the top view of FIG. 9A without the tube support, FIG. 10 schematically shows a side view of the knives and tube support of FIG. 9A, FIG. 11 schematically shows a further side view of the knives and tube support of FIG. 9A, FIG. 12A schematically shows a further top view in the direction of the centre axis of the knives and tube support of the cutting device of FIG. 5, FIG. 12B schematically shows the top view of FIG. 12A without the tube support, FIG. 13A schematically shows a side view of the knives and tube support of FIG. 12A, FIG. 13B schematically shows the side view of FIG. 13A without the tube support, FIG. 14A schematically shows a further side view of the knives and tube support of FIG. 12A, FIG. 14B schematically shows the side view of FIG. 14A without the tube support, FIG. 15A schematically shows a view in perspective of the knife trajectory of the cutting device of FIG. 5, FIG. 15B schematically shows a side view of the knife trajectory of FIG. 15A, FIG. 15C schematically shows a further side view of the knife trajectory of FIG. 15A, FIG. 16 schematically shows an alternative embodiment of the system according to the invention, wherein the cutting device comprises one knife and one counterweight, and FIG. 17 schematically shows a view in perspective of the positioning device of the system of FIG. 1.

DETAILED DESCRIPTION OF THE INVENTION

The FIGS. 1-4 show views of an embodiment of the system 1 according to the invention. Said system 1 is configured to perform the method according to the invention.

The system 1 comprises a mandrel 4, a winding device 5 for helically winding strips 2 around the mandrel 4 to form a base tube 6 moving away from the mandrel 4 at a tube speed $v_t$ (meter/second), a strip suppling device 7 for supplying the strips 2 to the winding device 5, a cutting device 8 for cutting the base tube 6 at a predetermined length $l_t$ to form the lengths of tube 3 while the base tube 6 is moving in a tube direction 9 at the tube speed $v_t$, and a positioning device 80 for positioning the cut lengths of tube 3. The system 1 comprises a support frame 110.

The supplying device 7 supplies a first strip 2A, a second strip 2B and a third strip 2C. The first strip 2A is moved along a wax unit 64 configured to provide a layer of wax onto a contact side of the first strip 2A. During the helically winding of the strips 2 around the mandrel 4, the contact side of the first strip 2A will be in contact with the mandrel 4. The layer of wax functions as a lubrication between the mandrel 4 and the first strip 2A.

During the helically winding, the second strip 2B and the third strip 2C are not in direct contact with the mandrel 4. The second strip 2B is moved along a first adhesive unit 65A to apply a layer of adhesive to the second strip 2B so that it will adhere to the first strip 2A. The third strip 2C is moved along a second adhesive unit 65B to apply a layer of adhesive to the third strip 2C so that it will adhere to the second strip 2B. This way the base tube 6 is formed.

The first, second and third strips 2A-C are paper strips 2. The strip supplying device 7 is configured to supply only paper strips 2 and the winding device 5 is configured to helically wind the paper strips 2 around the mandrel 4. In other embodiments of the system 1, the strip supplying device 7 may be configured to (also) supply strips 2 made from a different material, such as one or more plastics.

The mandrel 4 has an elongate form defining a longitudinal mandrel axis 44 extending in line with the tube direction 9.

The winding device 5 comprises a first winding roller 61 and a second winding roller 62 located at opposite sides of the mandrel 4. The first winding roller 61 is rotatable about a first roller axis 71 and the second winding roller 62 is rotatable about a second roller axis 72. A winding belt 63 extends around the first winding roller 61 and the second winding roller 62. The winding belt 63 is wound around the mandrel 4. The winding device 5 comprises a winding drive 60 operatively coupled to the first winding roller 61 for rotation about the first roller axis 71 as shown by the first rotation arrow 73. This will cause a movement of the winding belt 63 around the mandrel 4 and around the second roller axis 72 of the second winding roller 62 as indicated by the second rotation arrow 74. The winding belt 63 will helically wind the strips 2 around the mandrel 4 to form the base tube 6 moving along and away from the mandrel 4 at the tube speed $v_t$. The base tube 6 comprises a longitudinal tube axis 49. Due to the winding movement of winding belt 63, the base tube 6 rotates around its longitudinal tube axis 49.

The system 1 comprises a controller 50 having a first communication connection 51 with the winding device 5, more specifically with the winding drive 60 of the winding device 5.

The cutting device 8 comprises a knife displacement drive 42 and a knife rotation drive 35 (for more details see FIG. 5). The knife displacement drive 42 is connected to the controller 50 via a second communication connection 52. The knife rotation drive 35 is connected to the controller 50 via a third communication connection 53.

The positioning device 80 comprises a positioning wheel 83 which is rotatable about a positioning axis 82 and configured to place a vertically extending length of tube 3 in a horizontal position. The positioning device 80 comprises a positioning drive 81 which is connected to the controller 50 via a fourth communication connection 54.

The cutting device 8 is shown in detail in FIG. 5. The base tube 6 enters the cutting device 8 via a support tube 89 while moving with the tube speed $v_t$ in the tube direction 9. The knife displacement drive 42 comprises a knife displacement gear wheel 45 which is operatively coupled with a knife displacement gear ring 38 via a knife displacement belt 46. The knife displacement gear ring 38 comprises first outer threads 37 (see also FIG. 6). The knife rotation drive 35 comprises a knife control gear wheel 47 which is operatively coupled with a knife control gear ring 36 via a knife control belt 48. The knife control gear ring 36 comprises second outer threads 39 (see also FIG. 6).

In order to protect users against the knives 10, the cutting device 8 comprises a cutting housing 100. The cutting housing 100 comprise a control housing part 97 and a knife housing part 99. The control housing part 97 is attached to the knife control gear ring 36 in order to rotate along with the knife control gear ring 36. The knife housing part 99 is not fixated to the knife control gear ring 36 or the control housing part 97, due to which the knife housing part 99 is able to rotate relative to the knife control gear ring 36 and the control housing part 97. The knife housing part 99 is attached to the knife displacement gear ring 38 in order to rotate along with the knife displacement gear ring 38.

FIG. 6 shows the inside of the cutting device 8. The knife housing part 99 has been removed and the knife control gear ring 36 and the control housing part 97 are shown in a cross sectional view. The cutting device 8 comprises four knives 10 which are movable along a knife trajectory 11 surrounding a centre axis 12 and extending over a knife axial distance $d_{ak}$ along the centre axis 12 (see also the FIGS. 9 and 10). In other embodiments of the system 1, the cutting device 8 comprises only one knife or two, three or five or six knives 10.

The knife trajectory 11 forms, when viewed in a direction 15 of the centre axis 12, a virtual circle 13 having a knife radius distance $r_k$ and a circle centre 14 coinciding with the centre axis 12 (see also FIG. 9A). The knife trajectory 11 comprises a cutting part 17 in which the knives 10 are moved over the knife axial distance $d_{ak}$ in the tube direction 9 while, when viewed in the direction 15 of the centre axis 12, moving along the virtual circle 13. The knife trajectory 11 further comprises a retrieving part 18 in which the knives 10 are moved over the knife axial distance $d_{ak}$ and opposite to the tube direction 9 while, when viewed in the direction 15 of the centre axis 12, moving along the virtual circle 13 (see also FIG. 9B). The cutting device 8 is configured to cut the base tube 6 with the knives 10 moving along the cutting part 17 of the knife trajectory 11 (see also the FIGS. 12A and 12B).

The cutting device 8 comprises a first displacement unit 19 configured to displace the knives 10 around the centre axis 12 and, when viewed in the direction of centre axis 12, along the virtual circle 13 and a second displacement unit 20 configured to displace the knives 10 over the knife axial distance $d_{ak}$ in the tube direction 9 and opposite thereto. A knife displacement drive 42 which is operatively coupled to the first displacement unit 19 and the second displacement unit 20 and configured to move the knives 10, when viewed in the direction 15 of the centre axis 12, along the virtual circle 13 at a rotational knife speed $\omega_k$ (cycles/min)—see also FIG. 9A—and to move the knives 10 over at least part of the knife axial distance $d_{ak}$ in the tube direction 9 at an axial knife speed $v_k$ (meter/second) equal to the tube speed $v_t$ when the knives 10 move along the cutting part 17 of the knife trajectory 11 and cuts the base tube 6 (see also FIG. 13A).

In this system 1, the knives 10 of the cutting device 8 extend over a relatively short distance in the tube direction 9. As a result, the system 1 is relatively shorter in the tube direction 9.

The configuration of the cutting device 8 allows that the cutting device 8 creates a relatively more accurate cut in the base tube 6.

The configuration of the cutting device 8 also allows that the cutting device 8 operates at a relatively higher speed.

This is amongst others caused by the specific movement of the knives 10 along the knife trajectory 11.

Besides the function of cutting the base tube 6, the knives 10 have the function of acting as counterweights 40. In other embodiments of the system 1, the cutting device 8 may comprise a different type of counterweight 40 which is movable along the knife trajectory 11 or at a counterweight 40 trajectory at a constant counterweight 40 distance from the knife trajectory 11 to balance the movement of the knives 10 along the trajectory.

FIG. 16 shows the inside of a cutting device 8 of an alternative embodiment of the system 1. It differs from the embodiment of the FIG. 1-14 in that the cutting device 8 comprises only one knife and one counterweight 40 (not being a knife).

The first displacement unit 19 and the second displacement unit 20 are configured to continuously displace a same number of knives 10 along the cutting part 17 of the knife trajectory 11 as displaced along the retrieving part 18 of the knife trajectory 11.

The first displacement unit 19 comprises knife supports 29 holding the knives 10 at the knife radius distance $r_k$ from the centre axis 12, while allowing movement of the knives 10 over the knife axial distance $d_{ak}$ parallel to the centre axis 12. The first displacement unit 19 is configured to rotate the knife supports 29 around the centre axis 12, while holding the knives 10 at the knife radius distance $r_k$ from the centre axis 12. The knife supports 29 are attached to the knife displacement gear ring 38 to move along with the knife displacement gear ring 38. Each knife support comprises two support beams 90 extending parallel to the centre axis 12 and a knife slider 91 which is movable along the support beams 90. The knives 10 are rotatably attached to the knife sliders 91 via a rotation beam 92.

The second displacement unit 20 comprises cams 31 attached to the knives 10 and a cam track 32 configured to displace the knives 10 over the knife axial distance $d_{ak}$ parallel to the centre axis 12 in the tube direction 9 when the knives 10 move along the cutting part 17 of the knife trajectory 11 and to move the knives 10 over the knife axial distance $d_{ak}$ parallel to the centre axis 12 and opposite to the tube direction 9 when the knives 10 move along the retrieving part 18 of the knife trajectory 11. The cam track 32 is shown in more detail in FIG. 8.

The knives 10 are rotating knives 33 having a rotation axis 34 extending parallel to the centre axis 12. The knives 10 are operatively attached to a knife rotation gear wheel 93 surrounding the rotation axis 34. The cutting device 8 comprises a knife rotation gear ring 94 engaging the knife rotation gear wheels 93 of the knives 10 and having a knife rotation ring centre 98 coinciding with the centre axis 12. The knife rotation gear ring 94 comprises inner threads 95. The knife rotation gear wheels 93 and the knife rotation gear ring 94 cooperate to rotate the knives 10 about their rotation axis 34 when the knives 10 are, when viewed in the direction 15 of the centre axis 12, moved along the virtual circle 13. The knife rotation gear ring 94 is rotatable about the knife rotation ring centre 98 and the cutting device 8 comprises a knife rotation drive 35 configured to rotate the knife rotation gear ring 94 about the knife rotation ring centre 98 in order to adjust a rotational cutting speed $\omega_c$ (cycles/minute) with which the knives 10 rotate around their rotation axis 34. The knife rotation gear ring 94 is attached to the control housing part 97 in order to move along with the control housing part 97. This way, the control housing part 97 has the function of a control connector 96 which operatively couples the knife rotation gear ring 94 and the knife control gear ring 36 driven by the knife rotation drive 35. The knife rotation gear ring 94 is shown in more detail in FIG. 7.

The controller 50 is connected with the knife rotation drive 35 via the third communication connection 53. The controller 50 is configured to control the rotational cutting speed $\omega_c$ with which the knives 10 rotate around their rotation axis 34 by adjusting the rotation of the knife rotation gear ring 94 about the knife rotation ring centre 98.

The controller 50 is connected to the winding device 5 via the first communication connection 51 and to the knife displacement drive 42 via the second communication connection 52. The controller 50 is configured to control the tube speed $v_t$ with which the base tube 6 moves away from the mandrel 4 and the rotational knife speed $\omega_k$ with which the knife is, when viewed in direction 15 of the centre axis 12, moved along the virtual circle 13.

The predetermined length $l_t$ of the lengths of tube 3 produced by the system 1 is determined by the tube speed $v_t$ with which the base tube 6 moves away from the mandrel 4 and the rotational knife speed $\omega_k$ with which the knife is, when viewed in direction 15 of the centre axis 12, moved along the virtual circle 13. When a desired predetermined length $l_t$ of the lengths of tube 3 is reached, the system will operate in practice with a constant tube speed $v_t$ and knife speed $\omega_k$.

FIG. 9A shows a top view in the direction 15 of the centre axis 12 of the knives 10 and the tube support 41 of the cutting device 8 shown in FIG. 5. FIG. 9B shows the top view of FIG. 9A without the tube support 41. FIG. 10 shows a side view of the knives 10 and the tube support 41 of FIG. 9A. FIG. 11 shows a further side view of the knives 10 and the tube support 41 of FIG. 9A.

The tube support 41 is configured to hold the base tube 6 in the knife trajectory 11. The tube direction 9 extends parallel to the centre axis 12. The longitudinal tube axis 49 of the base tube 6 extends parallel to the centre axis 12.

The cutting part 17 of the knife trajectory 11 starts at a cutting part starting position 21 on the knife trajectory 11 and ends at a cutting part ending position 22 on the knife trajectory 11. The retrieving part 18 of the retrieving trajectory starts at a retrieving part starting position 23 on the knife trajectory 11 and ends at a retrieving part ending position 24 on the knife trajectory 11. The retrieving part ending position 24 and cutting part starting position 21 coincide, and the cutting part ending position 22 and the retrieving part starting position 23 coincide. The knife trajectory 11 has, when viewed in a transverse direction 16 extending perpendicular to the centre axis 12, an oval-like shape.

The knives 10 are, when viewed in the direction 15 of the centre axis 12, located at an equal distance $d_{ck}$ from each other along the virtual circle 13. The cutting part 17 and the retrieving part 18 of the knife trajectory 11 are, when viewed in the direction 15 of the centre axis 12, located at opposite sides of the virtual circle 13. The cutting part 17 of the knife trajectory 11 has a cutting part length $l_{cp}$, the retrieving part 18 of the knife trajectory 11 has a retrieving part length $l_{rp}$, and the retrieving part length $l_{rp}$ is equal to the cutting part length $l_{rp}$.

In the situation shown in the FIGS. 9-11, the fourth knife 10D is about to start to move along the cutting part 17 of the knife trajectory 11 and has an axial knife speed $v_{k-a}$ equal to the tube speed $v_t$ and in the tube direction 9. The first knife 10A is located halfway the cutting part 17 of the knife trajectory 11. The second knife 10B is about to start to move along the retrieving part 18 of the knife trajectory 11. The third knife 10C is located halfway the retrieving part 18 of the knife trajectory 11. The third knife 10C is located halfway the retrieving part 18 of the knife trajectory 11 and has an axial knife speed $v_{k-c}$ equal to the tube speed $v_t$ and opposite to the tube direction 9.

FIG. 12A shows a further top view in the direction 15 of the centre axis 12 of the knives 10 and tube support 41 of the cutting device 8 of FIG. 5. FIG. 12B shows the top view of FIG. 12A without the tube support 41. FIG. 13A shows a side view of the knives 10 and tube support 41 of FIG. 12A. FIG. 13B shows the side view of FIG. 13A without the tube support 41. FIG. 14A shows a further side view of the knives 10 and tube support 41 of FIG. 12A. FIG. 14B shows the side view of FIG. 14A without the tube support 41.

In the situation shown in the FIGS. 12-14, the knives 10 are moved a bit further along the knife trajectory 11 when compared with the FIGS. 9-11. The first knife 10A is moving along the cutting part 17 of the knife trajectory 11 and is located closer to the cutting part ending position 22 than to the cutting part starting position 21. The first knife 10A is cutting the base tube 6 and extends through part of the base tube 6. In other words, the first knife 10A is moved through part of the base tube 6. More specifically, a cutting area 43 of the first knife 10A is moved through part of the base tube 6. Since the winding device 5 is configured to rotate the base tube 6 around the mandrel 4, the base tube 6 rotates around its longitudinal tube axis 49. Due to this rotation of the base tube 6, the first knife 10A extending through part of the base tube 6 creates a complete cut separating a length of tube 3 having a predetermined length $l_t$ from the base tube 6. The first knife 10A has an axial knife speed $v_{k-a}$ equal to the tube speed $v_t$ and in the tube direction 9. This means that when the first knife 10A is cutting the base tube 6, the first knife 10A and the base tube 6 have the same speed in the tube direction 9. This ensures that the first knife 10A creates an accurate cut, even though the first knife 10A during the cutting of the base tube 6 also moves, when viewed in the direction 15 of the centre axis 12, along the virtual circle 13 at the rotational knife speed $\omega_k$.

The second knife 10B is moving along the retrieving part 18 of the knife trajectory 11 and is located closer to the retrieving part starting position 23 than to the retrieving part ending position 24. The third knife 10C is moving along the retrieving part 18 of the knife trajectory 11 and is located closer to the retrieving part ending position 24 than to the retrieving part starting position 23. The fourth knife 10D is moving along the cutting part 17 of the knife trajectory 11 and is located closer to the cutting part starting position 21 than to the cutting part ending position 22. The first knife 10A and the fourth knife 10D have an axial knife speed $v_{k-a}$, $v_{k-d}$ equal to the tube speed $v_t$ and in the tube direction 9. The second knife 10B and the third knife 10C have an axial knife speed $v_{k-b}$, $v_{k-c}$ equal to the tube speed $v_t$ and opposite to the tube direction 9. All the knives 10 move, when viewed in the direction 15 of the centre axis 12, along the virtual circle 13 at the rotational knife speed $\omega_k$.

FIG. 15A shows a view in perspective of the knife trajectory 11 of the cutting device 8 of FIG. 5. The FIGS. 15B and 15C show side views of the knife trajectory 11. FIG. 15B shows a side view in the direction of the arrow 26 shown in FIG. 15C. FIG. 15C shows a side view in the direction of the arrow 16 shown in the FIGS. 9B and 15B.

FIG. 16 shows an alternative embodiment of the system 1 according to the invention. The cutting device 8 comprises only one knife 10 and one counterweight 40 not being a knife.

FIG. 17 shows a view in perspective of the positioning device of the system of FIG. 1. The positioning device 80 is configured to position the cut lengths of tube 3 in a horizontal position. The positioning wheel 83 receives the cut lengths of tube 3 and rotates them in a horizontal position on a conveyor belt 27.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

It will be apparent to those skilled in the art that various modifications can be made to the system and method shown in the accompanied schematic drawings without departing from the scope as defined in the claims.

The invention claimed is:

1. A system for producing lengths of tube from helically wound strips, said system comprising:

a mandrel, a winding device for helically winding strips around the mandrel to form a base tube moving away from the mandrel at a tube speed, wherein the winding device is configured to rotate the base tube around the mandrel, a strip suppling device for supplying the strips to the winding device, a cutting device for cutting the base tube at a predetermined length to form the lengths of tube while the base tube is moving in a tube direction at the tube speed, wherein:

the cutting device comprises a knife which is movable along a knife trajectory surrounding a centre axis and extending over a knife axial distance along the centre axis, the knife trajectory forms, when viewed in a direction of the centre axis, a circle having a knife radius distance and a circle centre coinciding with the centre axis, the knife trajectory comprises a cutting part in which the knife is moved over the knife axial distance in the tube direction while, when viewed in the direction of the centre axis, moving along the circle, the knife trajectory further comprises a retrieving part in which the knife is moved over the knife axial distance and opposite to the tube direction while, when viewed in the direction of the centre axis, moving along the circle, the cutting device is configured to cut the base tube with the knife moving along the cutting part of the knife trajectory, the cutting device is configured to move the knife through only part of the base tube when the knife is moved along the cutting part of the knife trajectory in order to create a complete cut separating the length of tube from the rotating base tube, the cutting device comprises:

a first displacement unit configured to displace the knife around the centre axis and, when viewed in the direction of centre axis, along the circle, a second displacement unit configured to displace the knife over the knife axial distance in the tube direction and opposite thereto, and a knife displacement drive which is operatively coupled to the first displacement unit and the second displacement unit and configured to move the knife, when viewed in the direction of the centre axis, along the circle at a rotational knife speed and to move the knife over at least part of the knife axial distance in the tube direction at an axial knife speed when the knife moves along the cutting part of the knife trajectory and cuts the base tube.

2. The system according to claim 1, wherein the culling device comprises a counterweight which is movable along the knife trajectory or at a counterweight trajectory at a constant counterweight distance from the knife trajectory to balance the movement of the knife along the trajectory.

3. The system according to claim 2, wherein the counterweight is a further knife which is movable along the knife trajectory and configured to cut the base tube.

4. The system according to claim 1, wherein the culling device comprises multiple knives which are movable along the knife trajectory to cut the base tube and the first displacement unit and the second displacement unit are configured to continuously displace a same number of knives along the cutting part of the knife trajectory as displaced along the retrieving part of the knife trajectory.

5. The system according to claim 4, wherein the knives are, when viewed in the direction of the centre axis, located at an equal distance from each other along the circle.

6. The system according to claim 4, wherein the cutting device comprises an even number of knives.

7. The system according to claim 1, wherein the cutting part and the retrieving part of the knife trajectory are, when viewed in the direction of the centre axis, located at opposite sides of the circle.

8. The system according to claim 1, wherein the cutting part of the knife trajectory has a cutting part length, the retrieving part of the knife trajectory has a retrieving part length, and the retrieving part length is equal to the cutting part length.

9. The system according to claim 1, wherein the second displacement unit is configured to move the knife at an axial knife speed equal to the tube speed and opposite to the tube direction when the knife moves along the retrieving part of the knife trajectory.

10. The system according to claim 1, wherein:

the cutting part of the knife trajectory starts at a cutting part starting position on the knife trajectory and ends at a cutting part ending position on the knife trajectory, the retrieving part of the retrieving trajectory starts at a retrieving part starting position on the knife trajectory and ends at a retrieving part ending position on the knife trajectory, the retrieving part ending position and cutting part starting position coincide, and the cutting part ending position and the retrieving part starting position coincide.

11. The system according to claim 1, wherein the knife trajectory has, when viewed in a transverse direction extending perpendicular to the centre axis, an oval like shape.

12. The system according to claim 1, wherein:

the first displacement unit comprises a knife support holding the knife at the knife radius distance from the centre axis, while allowing movement of the knife over the knife axial distance parallel to the centre axis, the first displacement unit is configured to rotate the knife support around the centre axis, while holding the knife at the knife radius distance from the centre axis, and the second displacement unit comprises a cam coupled to the knife and a cam track configured to displace the knife over the knife axial distance parallel to the centre axis in the tube direction when the knife moves along the cutting part of the knife trajectory and to move the knife over the knife axial distance parallel to the centre axis and opposite to the tube direction when the knife move along the retrieving part of the knife trajectory.

13. The system according to claim 1, wherein the knife is a rotating knife having a rotation axis extending parallel to the centre axis.

14. The system according to claim 13, wherein:

the knife is operatively attached to a knife rotation gear wheel surrounding the rotation axis of said knife, the cutting device comprises a knife rotation gear ring engaging the knife rotation gear wheel of the knife and having a knife rotation ring centre coinciding with the centre axis, and the knife rotation gear wheel and the knife rotation gear ring cooperate to rotate the knife about its rotation axis when the knife is, when viewed in the direction of the centre axis, moved along the circle.

15. The system according to claim 14, wherein the knife rotation gear ring is rotatable about the knife rotation ring centre and the cutting device comprises a knife rotation drive configured to rotate the knife rotation gear ring about the knife rotation ring centre in order to control a rotational cutting speed with which the knife rotates around its rotation axis.

16. The system according to claim 1, wherein the system comprises a tube support configured to hold the base tube in the knife trajectory.

17. The system according to claim 1, wherein the tube direction is parallel to the centre axis.

18. The system according to claim 1, wherein the base tube comprises a longitudinal tube axis extending parallel to the centre axis.

19. The system according to claim 1, wherein the mandrel has an elongate form defining a longitudinal mandrel axis extending in line with the tube direction.

20. The system according to claim 1, wherein the strip supplying device is configured to supply paper strips and the winding device is configured to helically wind the paper strips around the mandrel.

21. The system according to claim 20, wherein the strip supplying device is configured to supply only paper strips.

22. The system according to claim 1, wherein:

the system comprises a controller having a first communication connection with the winding device and a second communication connection with the knife displacement drive, and the controller is configured to control the tube speed with which the base tube moves away from the mandrel and the rotational knife speed with which the knife is, when viewed in direction of the centre axis, moved along the circle.

23. The system according to claim 22, wherein the controller comprises a third communication connection with the knife rotation drive and the controller is configured to control the rotational cutting speed with which the knife rotates around its rotation axis by adjusting the rotation of the knife rotation gear ring about the knife rotation ring centre.

24. The system according to claim 1, wherein the cutting device is configured to move a cutting area of the knife along the knife trajectory.

25. A method for producing lengths of tube with a system according to claim 1, said method comprising:

supplying strips with the strip supplying device to the winding device and helically winding said strips around the mandrel to form a base tube moving away from the mandrel at a tube speed, cutting the base tube at a predetermined length with the cutting device while the base tube is moving in a tube direction at the tube speed and the knife of the cutting device is moved along the cutting part of the knife trajectory, and driving the first displacement unit and the second displacement unit with the knife displacement drive to move the knife, when viewed in the direction of the centre axis, along the circle at a rotational knife speed and to move the knife over at least part of the knife axial distance in the tube direction at an axial knife speed equal to the tube speed when the knife moves along the cutting part of the knife trajectory and cuts the base tube.

26. The system according to claim 1, wherein the axial knife speed is equal to the tube speed when the knife moves along the cutting part of the knife trajectory and cuts the base tube.

* * * * *